US012442260B2

(12) United States Patent
Peng et al.

(10) Patent No.: US 12,442,260 B2
(45) Date of Patent: Oct. 14, 2025

(54) PILING MACHINE AND CAST-IN-PLACE PILE

(71) Applicant: Hainan Zhuodian High Tech Development Co., Ltd., Haikou (CN)

(72) Inventors: Ying Peng, Haikou (CN); Guijiao Peng, Haikou (CN); Huayuan Li, Haikou (CN); Songbin Chen, Haikou (CN); Haitong Chen, Haikou (CN); Yanji Tan, Haikou (CN)

(73) Assignee: Hainan Zhuodian High Tech Development Co., Ltd., Haikou (CN)

( * ) Notice: Subject to any disclaimer, the term of this patent is extended or adjusted under 35 U.S.C. 154(b) by 0 days.

(21) Appl. No.: 18/767,192

(22) Filed: Jul. 9, 2024

(65) Prior Publication Data

US 2025/0043642 A1 Feb. 6, 2025

(51) Int. Cl.

| | |
|---|---|
| ***E21B 19/15*** | (2006.01) |
| ***E21B 3/02*** | (2006.01) |
| ***E21B 7/02*** | (2006.01) |
| ***E21B 19/089*** | (2006.01) |
| ***E21B 19/14*** | (2006.01) |

(52) U.S. Cl.

CPC ..... *E21B 19/155* (2013.01); *E21B 3/022* (2020.05); *E21B 7/023* (2013.01); *E21B 19/089* (2013.01); *E21B 19/14* (2013.01)

(58) Field of Classification Search

CPC ..... E21B 7/023; E21B 15/003; E21B 7/02; E21B 7/024; E21B 19/155; E21B 3/022; E21B 19/14

See application file for complete search history.

(56) References Cited

U.S. PATENT DOCUMENTS

| | | | | |
|---|---|---|---|---|
| 3,734,210 A * | 5/1973 | Wilderman | ..... | E21B 19/20 414/22.55 |
| 2007/0092358 A1* | 4/2007 | Innes | ..... | E21B 7/02 414/22.51 |

FOREIGN PATENT DOCUMENTS

| | | | | |
|---|---|---|---|---|
| AU | 2008207706 A1 | 2/2009 | | |
| CN | 202688997 U | 1/2013 | | |
| CN | 203851446 U | 10/2014 | | |
| CN | 105756060 A | 7/2016 | | |
| CN | 107905746 A | 4/2018 | | |
| CN | 109372429 A * | 2/2019 | ..... | E21B 15/003 |
| CN | 109915048 A | 6/2019 | | |
| CN | 208950504 U | 6/2019 | | |

(Continued)

OTHER PUBLICATIONS

International Search Report issued in PCT/CN2023/128778, mailed Apr. 16, 2024.

*Primary Examiner* — Robert E Fuller

(74) *Attorney, Agent, or Firm* — Troutman Pepper Locke LLP; Scott D. Wofsy

(57) ABSTRACT

A piling machine includes a portal frame, a pile frame platform, a moving assembly, and a lifting assembly. The portal frame is erected at one side of the pile frame platform, and a power head is installed on the portal frame. A loading zone is located at the pile frame platform, and a projection of a central shaft of the power head on the pile frame platform is located in an extension direction of the loading zone. The moving assembly is located at one side or each of both sides of the loading zone, and multiple drill pipes are horizontally distributed on the moving assembly, and each drill pipe is perpendicular to a plane where the portal frame is located.

13 Claims, 34 Drawing Sheets

(56) References Cited

FOREIGN PATENT DOCUMENTS

| | | | |
|---|---|---|---|
| CN | 209469396 | U | 10/2019 |
| CN | 209556966 | U | 10/2019 |
| CN | 110939132 | A | 3/2020 |
| CN | 107023267 | B | 4/2020 |
| CN | 216381270 | U | 4/2022 |

* cited by examiner

PILING MACHINE AND CAST-IN-PLACE PILE

CROSS-REFERENCE TO RELATED APPLICATION

This patent application claims the benefit and priority of Chinese Patent Application No. 202310959616.0 filed with the China National Intellectual Property Administration on Jul. 31, 2023, the disclosure of which is incorporated by reference herein in its entirety as part of the present application.

TECHNICAL FIELD

The present disclosure relates to the technical field of pile foundation construction, and in particular to a piling machine, and a cast-in-place pile construction method.

BACKGROUND

Pile foundation engineering is a constituent project in building engineering, with the purpose of increasing the bearing capacity of natural soil in building foundation by adding pile foundation, or directly transferring the load at the upper part of the building to a solid and powerful soil layer through pile foundation, thus making the bearing capacity of the building foundation meet the safety requirements.

Pile foundation is a rod member composed of concrete, steel and other materials with mechanical properties, which is usually cylindrical or square upright column. But in recent years, special-shaped pile foundations with full-length threads, partial threads and partial enlarged body have also been developed. Based on the construction process, the pile foundations are divided into two types: precast pile and cast-in-place pile. The precast pile refers to a pile foundation prepared in advance outside the construction area, and the cast-in-place pile refers to the pile foundation constructed by drilling holes and pouring concrete at the construction area.

The machinery used to construct the cast-in-place pile is pile-driving machinery with a hollow drilling tool, and the drill tool is used to drill holes in the soil in the construction area and serves as a channel for pouring concrete in the process of lifting the drilling tool. By means of the drilling tool, the pile foundation can be formed by pouring concrete (or other pouring materials) at one time. The pile-driving machinery, whether in China or abroad, falls into two categories: the first type is a traditional pile driver, with the length of the upright column and the drilling tool meeting the design requirements of the pile foundation; during the operation of the traditional pile driver, the drilling tool of the pile driver needs to be perpendicular to the ground, so as to drill a hole, and a pile can be formed by lifting the drill tool and casting the concrete in place; meanwhile, the overall length of the upright column of the pile driver for supporting the drill tool and the drilling tool must be higher than a designed pile length; the second type is a pile driver with multiple drill pipes supplemented at one side of the upright column of the pile driver in parallel to meet the design requirements of the pile foundation, specifically, the drill pipe with a drill bit of the drilling tool is arranged on the upright column of the pile driver, and one or more supplementary drill pipes are erected on one side of an original drill pipe on the upright column of the pile driver in parallel, so as to be connected to the original drill pipe when the drilling depth is insufficient. The first type of pile-driving machinery has occupied the vast market due to its mature construction and application, while the second type of pile-driving machinery is a new pile driver that has appeared in recent ten years, such as those provided in CN216381270U, CN105756060A and CN107023267B.

The first type of traditional pile driver is limited by the total length of the upright column and the drilling tool of the pile driver, and the height of the upright column and drilling tool of the pile driver has not exceeded the precedent of 80 meters. For example, when the pile foundation is designed to have the length of 60 meters, the total length of the drilling tool should be more than 60 meters. Because the pile foundation needs to be provided with a guide rail which is convenient for lowering and lifting the drilling tool, the upright column for supporting the guide rail should be longer. Moreover, because the drilling tool needs to be perpendicular to the ground when working, and the upright column needs to be provided with a power head weighing 10-20 tons in addition to the drilling tool, an upright column towering structure of tens of meters or more will be formed during the operation of the traditional pile driver. When the power head is at the top end of the upright column, the center of gravity of the whole pile driver is extremely high, and the resulting collapse phenomenon occurs in common. Based on this, the traditional pile driver with too high upright column has been banned in some areas.

According to the second type of pile driver, the height of the upright column of the pile driver can be reduced by vertically arranging multiple drill pipes in parallel in advance and then connecting the drill pipes, thus reducing the collapse risk. However, such pile drivers are mostly used in the construction of light pile foundations with small diameters, and the drill pipe used on the pile foundation can often be pulled up by one person. When such pile drivers are configured for the construction of the pile foundation with a diameter of 400 mm or more, the length and weight of each drill pipe of the drilling tool need to be correspondingly increased (the weight of the drill pipe is dozens of times more than that of the drill pipe used in the construction of the light pile foundation with small diameter, and is 3-6 tons). Therefore, even though the scheme of erecting spare drill pipes for spare use are provided in CN216381270U, CN105756060A and CN107023267B, due to the fact that the drill pipe is a heavy component in practical application, and each erected drill pipe weighs several tons, the drilling tool has high center of gravity and poor stability, and is easy to collapse to cause crushing accidents. Moreover, the drilling tool has greater requirements on the strength of an erecting mechanism of the pile driver, which requires more materials and higher cost. Therefore, the existing pile driver is still difficult to meet the construction requirements of the heavy-duty pile foundation with large diameter. As the contact area between the drilling tool and the pile driver body is small when the drilling tool is placed vertically, the pressure in the concentrated force-bearing area is strong, and the structural strength of the pile driver equipped with the heavy drilling tool will undergo a great test.

In addition, for the second type of pile driver, a dual-purpose long-spiral full-automatic pile driver is provided by CN202688997U, the pile driving depth can be increased by 15 m without increasing the height of the pile driver. However, only an upright column mechanism capable of rotating around the axis to switch between a drilling state and a cage lowering state is provided, and how to improve the drilling tool and connect the spare drill pipe with the original drill pipe by the drilling tool are not provided. A combined power hole-forming pile driver is provided in CN208950504U. According to the disclosure, two sets of power head and drilling tool systems are vertically arranged along the upright column. When the stroke of the first set of drilling tool and power head system is exhausted, the drilling tool is separated from the power head, and then the first set of drilling tool is connected to the second set of power head and drilling tool system by a slide rail device to increase the piling depth. However, by increasing the power head and drilling tool system, the weight of the top end of the upright column will be increased, which is more likely to cause the safety accident such as machine collapse. Moreover, the power head is usually the most expensive component of the pile driver, and two sets of power heads will undoubtedly greatly increase the manufacturing cost of the pile driver. In CN209556966U, an automatic workover rig substructure device on offshore platform is provided. According to the automatic workover rig substructure device, the tubing is transported to a mechanical arm by a tubing loading mechanism, and then the tubing is lifted by the mechanical arm to be fed into a well. In this process, other auxiliary equipment is required to achieve the continuous supply of the tubing. However, as the tubing is a light component, a drilling tool having the length of 6-8 m on the pile driver weighs about 4-6 tons. If the tubing transportation mode provided in the CN209556966U is adopted, that is, the transportation mode of the drilling tool is achieved by the way of free falling into the mechanical arm and the well, which may cause damage to the mechanical structure and the drilling tool of the pile driver. The disclosed transportation mode also requires auxiliary machinery such as cranes and manual cooperation, which will also greatly increase the cost. Therefore, the tubing transportation mode provided in CN209556966U is not suitable for heavy pile drivers. In addition, in order to ensure the balance of the pile driver, a counterweight device is provided by CN110939132A, which can adjust the expansion and retraction of an oil cylinder to change a filling space of an outer counterweight frame, and meanwhile, the counterweight can be increased or reduced, thus ensuring the verticality of the machine. However, the process of increasing or reducing the counterweight is complicated, which is not only time-consuming and laborious, but also requires other auxiliary machinery, greatly affecting the consistency of piling construction and increasing the cost.

Based on this, for the sake of safety and reliability, there is no reliable technology to solve the problem of how the pile driver provided with heavy drilling tools can still achieve stable drill pipe connection and ensure the stability of the pile driver even after multiple drill pipes are arranged in parallel in advance. Therefore, how to achieve stable drill pipe connection and maintain the stability of the pile driver provided with the heavy drilling tool is still a difficult technical problem to overcome.

SUMMARY

An objective of the present disclosure is to provide a piling machine, and a cast-in-place pile construction method, so as to solve the technical problems in the prior art that the connection process of the drill pipes in the pile driver is difficult and the stability of the pile driver is difficult to be guaranteed, which are caused in a situation that the weight and length of each drill pipe need to be correspondingly increased when the existing pile driver provided with multiple vertical drill pipes arranged in parallel with an original drill pipe on one side of an upright column is applied to the construction process of a heavy-duty pile foundation with a large diameter.

In a first aspect, a piling machine includes a portal frame, a pile frame platform, a moving assembly, and a lifting assembly.

The portal frame is erected on one side of the pile frame platform, a power head capable of ascending and descending is installed on the portal frame, and the power head can be detachably connected to one end of any drill pipe moved to a position below the power head.

A loading zone is located at a position of the pile frame platform at one side of the portal frame, and a projection of a central shaft of the power head on the pile frame platform is located in an extension direction of the loading zone.

The moving assembly is located at one side or each of both sides of the loading zone, multiple drill pipes are horizontally distributed on the moving assembly, and each drill pipe is perpendicular to a plane where the portal frame is located; the moving assembly is configured for moving on a horizontal plane in a direction parallel to the plane where the portal frame is located, so as to convey the multiple drill pipes to the loading zone in turn.

The lifting assembly includes a picking part, the picking part is configured for grasping the drill pipe at the loading zone; the lifting assembly is configured for pivoting relative to the pile frame platform, so as to drive the drill pipe grasped by the picking part to switch from a horizontal state to an upright state and to move to the position below the power head in the pivoting process.

In an alternative embodiment, the moving assembly includes multiple sliding mechanisms, the multiple sliding mechanisms are distributed at intervals in a direction perpendicular to the plane where the portal frame is located, and the multiple sliding mechanisms are configured for supporting the multiple drill pipes and moving the multiple drill pipes to move.

In the direction perpendicular to the plane where the portal frame is located, the picking part at the loading zone and the multiple sliding mechanisms are distributed in a staggered manner.

In an alternative embodiment, the multiple sliding mechanisms are of a telescopic structure, and configured for driving the drill pipe supported by the multiple sliding mechanisms to ascend and descend in a process of extending and retracting the multiple sliding mechanisms.

In an alternative embodiment, the pile frame platform is provided with multiple guide rails, the multiple guide rails are distributed at intervals in the direction perpendicular to the plane where the portal frame is located, and each guide rail extends in the direction parallel to the plane where the portal frame is located.

The multiple sliding mechanisms and the multiple guide rails are slidably connected in one-to-one correspondence.

In an alternative embodiment, each sliding mechanism is provided with a first clamping position and a second clamping position distributed at an interval, first clamping positions of the multiple sliding mechanisms are distributed in a straight line so as to support a drill pipe, and second clamping positions of the multiple sliding mechanisms are distributed on an other straight line to support an other drill pipe.

In an alternative embodiment, the lifting assembly includes a mechanical arm, and a jacking driving mechanism. The picking part is a mechanical gripper.

The mechanical arm includes a hinged end, and a suspension end. The hinged end of the mechanical arm is hinged with the pile frame platform, and the suspension end of the mechanical arm is suspended.

The mechanical gripper is installed on the mechanical arm, an output end of the jacking driving mechanism is connected to the mechanical arm, the jacking driving mechanism is configured for driving the mechanical arm to pivot relative to the pile frame platform, so as to make the mechanical arm switch between the horizontal state and the upright state.

In an alternative embodiment, the hinged end of the mechanical arm is located between the portal frame and the loading zone, the mechanical gripper is installed on an arm surface, facing away from the pile frame platform, of the mechanical arm; or the mechanical gripper is installed on an arm surface, facing the pile frame platform, of the mechanical arm, a turntable mechanism is installed on the pile frame platform, the hinged end of the mechanical arm is hinged to the turntable mechanism, and the turntable mechanism is configured for driving the mechanical arm to rotate about a central axis of the mechanical arm.

In an alternative embodiment, an extension frame is connected to one side, provided with the portal frame, of the pile frame platform. The hinged end of the mechanical arm is hinged to the extension frame, the mechanical arm can be erected at one side, facing away from the loading zone, of the portal frame after passing through the portal frame in the process of pivoting relative to the pile frame platform.

The mechanical gripper is installed on an arm surface, facing the pile frame platform, of the mechanical arm.

In an alternative embodiment, the piling machine further includes a self-adjusting counterweight assembly, a monitoring system, and a control system.

The self-adjusting counterweight assembly is installed on one side, away from the portal frame, of the pile frame platform, and includes a moving portion capable of moving in the direction perpendicular to the plane where the portal frame is located.

The self-adjusting counterweight assembly and the monitoring system are both connected to the control system. The monitoring system is configured for monitoring a weight change at the portal frame of the piling machine, and the control system is configured for calculating an amount of moving of the moving portion according to the weight change monitored by the monitoring system, and driving the moving portion to move in the direction perpendicular to the plane where the portal frame is located according to the moving amount.

In a second aspect, a cast-in-place pile construction method is provided, which is carried out by the piling machine above, and the method includes the following steps:

S1: starting the moving assembly to convey one of the multiple drill pipes on the moving assembly to the loading zone;

S2: starting the lifting assembly, enabling the picking part to grasp the drill pipe at the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and

S7: repeating steps of S1 to S6 to connect the multiple drill pipes on the moving assembly in turn and drill the multiple drill pipes into the soil at the designed pile location of the cast-in-place pile.

A piling machine provided by the present disclosure includes a portal frame, a pile frame platform, a moving assembly, and a lifting assembly. The portal frame is erected at one side of the pile frame platform, a power head capable of ascending and descending is installed on the portal frame, and the power head can be detachably connected to one end of any drill pipe moved to a position below the power head. A position of the pile frame platform at one side of the portal frame is provided with a loading zone, and a projection of a central shaft of the power head on the pile frame platform is located in an extension direction of the loading zone. One side or each of both sides of the loading zone is provided with the moving assembly, multiple drill pipes are horizontally distributed on the moving assembly, and each drill pipe is perpendicular to a plane where the portal frame is located. The moving assembly is configured for moving on a horizontal plane in a direction parallel to the plane where the portal frame is located, so as to convey the multiple drill pipes to the loading zone in turn. The lifting assembly includes a picking part for grasping the drill pipe at the loading zone, and the lifting assembly is configured for pivoting relative to the pile frame platform, so as to drive the drill pipe to switch from a horizontal state to an upright state and move to a position below the power head in the rotating process. The piling machine provided by the present disclosure is configured for the construction of a cast-in-place pile, and partially suitable for a cast-in-place pile with a long construction length. In order to reduce the height of the pile driver, a drilling tool suitable for the piling machine can be divided into multiple drill pipes, one of the multiple drill pipes is provided with a drill bit, which is regarded as an original drill pipe, and the rest are spare drill pipes. Prior to constructing the cast-in-place pile, the original drill pipe can be connected to the position below the power head on the portal frame, and the multiple spare drill pipes can be horizontally distributed on the moving assembly in turn. It should be noted that although the portal frame is erected on one side of the pile frame platform, and the original drill pipe is connected to a position below the power head installed on the portal frame, as the pile frame platform is further provided with the moving assembly and multiple spare drill pipes on the moving assembly are horizontally distributed, a large number of erected drill pipes will not be accumulated at the portal frame on the pile frame platform at this time, the center of gravity of the pile driver is free of shifting to the portal frame, and meanwhile, the multiple spare drill pipes horizontally distributed can play a role in balancing weight, thus effectively ensuring the balance stability of the piling machine. In the process of constructing a cast-in-place pile, the spare drill pipe and the original drill pipe need to be connected in turn to form a drilling tool. Specifically, the power head needs to be lowered on the portal frame and started, thus driving the original drill pipe to rotate to drill into the soil at a designed pile location, and then the power head is separated from the original drill pipe and raised to the original position on the portal frame, so as to be connected to the next spare drill pipe. When the power head drives the original drill pipe to move, it is necessary to move the moving assembly horizontally on the pile frame platform in the direction parallel to the plane where the portal frame is located, so as to convey one of the spare drill pipes to the loading zone. After the spare drill pipe is moved to the loading zone, the picking part of the lifting assembly is started to grasp the spare drill pipe at the loading zone. Then, the lifting assembly is started to pivot relative to the pile frame platform, as the projection of a central shaft of the power head on the pile frame platform is in an extension direction of the loading zone, the spare drill pipe grasped by the picking part can be switched from a horizontal state to an upright state by pivoting the lifting assembly; and meanwhile, the spare drill pipe is located below the power head after being erected. At this time, the power head and the spare drill pipe below the power head can be connected, and then the picking part is released and the lifting assembly is driven to return to the original position. Meanwhile, the power head is lowered until the spare drill pipe connected below the power head is moved to the top end of the original drill pipe. Afterwards, a bottom end of the spare drill pipe is connected to the top end of the original drill pipe, and then the power head is started to drive the spare drill pipe and the original drill pipe to rotate simultaneously, thus drilling the spare drill pipe into the soil boy at the designed pipe location. By repeating the above processes of moving the spare drill pipe, pivoting the spare drill pipe, connecting the spare drill pipe to the power head, lowering the power head, connecting the spare drill pipe to the original drill pipe, and drilling the spare drill pipe into the soil, the multiple spare drill pipes can be connected and drilled into the soil in turn, and thus a drilling tool formed by connecting the multiple drilling pipes can be drilled into the soil at the designed pile location of the cast-in-place pile. The drilling tool can satisfy the design length requirements of the cast-in-place, and can be used in constructing the cast-in-place pile. It should be noted that in the process of connecting the multiple drill pipes in turn, the horizontally distributed spare drill pipes that have not moved to the loading zone on the pile frame platform can continue to play the role of counterweight to ensure the balance and stability of the piling machine. Meanwhile, because each spare drill pipe will be driven into the soil after being connected, the weight at the portal frame is free of increasing continuously with the progress of the pipe connecting operation. Even if the pipe connecting operation enters the later stage, and there are no horizontal spare drill pipes distributed on the pile frame platform, the center of gravity of the piling machine is still free of shifting to the portal frame, and the stability of the piling machine can still be guaranteed.

Compared with the prior art, by horizontally placing multiple drill pipes on the orderly moving assembly and grasping and lifting each drill pipe point-to-point through the lifting assembly, the multiple drill pipes horizontally placed at different stations can be sent to the same position (below the power head) in the portal frame in turn by a single stroke route of the lifting assembly, such that the processes of conveying the drill pipes, connecting drill pipes and drilling the drill pipes into the soil can be carried out completely and orderly. Meanwhile, the piling machine can balance the pile driver by horizontally distributing multiple drill pipes on the moving assembly, so as to ensure the stability of the piling machine. In the process of connecting the drill pipes, the center of gravity of the piling machine can be kept from shifting to the portal frame by using the process of drilling the drill pipes into the soil after the drill pipes are connected and the horizontally distributed drill pipes that have not been connected, so as to keep the use stability of the piling machine.

A cast-in-place pile construction method, where the method is applied to the piling machine and includes the following steps: S1: starting the moving assembly to convey one of the multiple drill pipes on the moving assembly to the loading zone; S2: starting the lifting assembly, enabling the picking part to grasp the drill pipe at the loading zone, enabling the lifting assembly to pivot after the moving assembly is away from the loading zone, so as to drive the drill pipe grasped by the picking part to switch from the horizontal state to the upright state and move to the position below the power head; S3: connecting a top end of the drill pipe grasped by the picking part to the power head, and then enabling the picking part to release the grasped drill pipe; S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe; S5: continuing to drive the power head to descend and starting the power head, thus enabling the drill pipe connected below the power head to rotate and drill into soil at the designed pile location of the cast-in-place pile; S6: separating the power head from the drill pipe connected below the power head, and driving the power head to ascend; and S7: repeating steps of S1 to S6 to connect the multiple drill pipes on the moving assembly in turn and drill the multiple drill pipes into the soil at the designed pile location of the cast-in-place pile.

The cast-in-place pile construction method provided by the present disclosure is applied to the piling machine, which can achieve the same beneficial effects as the piling machine.

BRIEF DESCRIPTION OF THE DRAWINGS

To describe the technical solutions of the specific embodiments of the present disclosure or in the prior art more clearly, the following briefly introduces the accompanying drawings required for describing the specific embodiments or the prior art. Apparently, the accompanying drawings in the following description show merely some embodiments of the present disclosure, and those of ordinary skill in the art may still derive other drawings from these accompanying drawings without creative efforts.

Figure 1:
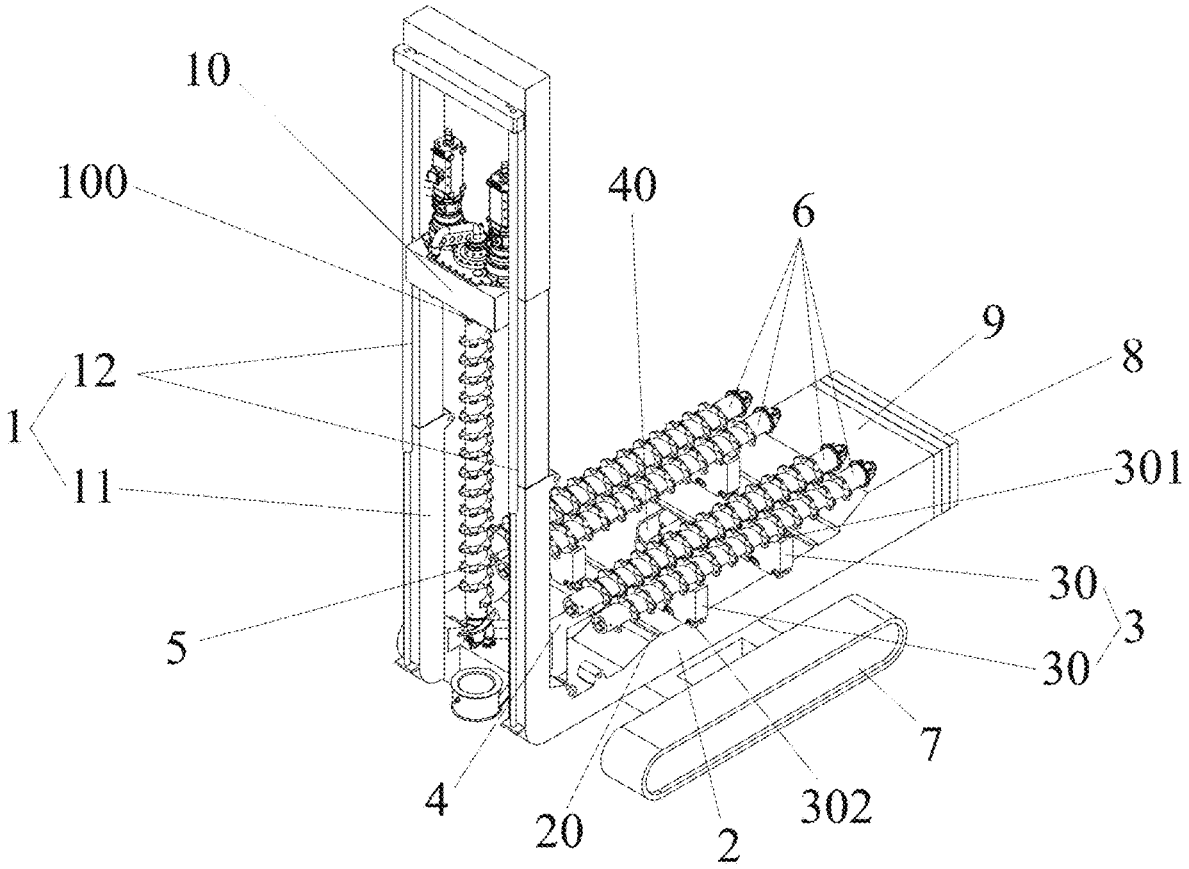
FIG. 1 is a structural schematic diagram of a piling machine according to an embodiment of the present disclosure.

In the drawings: 1 portal frame; 10 power head; 100 positioning part; 11 fixed rod; 12 lifting rod; 2 pile frame platform; 20 guide rail; 21 turntable mechanism; 22 extension frame; 3 moving assembly; 30 sliding mechanism; 300 first clamping position; 301 second clamping position; 302 pulley; 303 scissor mechanism; 304 sliding support; 4 lifting assembly; 40 picking part; 41 mechanical arm; 5 original drill pipe; 6 spare drill pipe; 7 traveling assembly; 8 self-adjusting counterweight assembly; 9 control system.

DETAILED DESCRIPTION OF THE EMBODIMENTS

To make the objectives, technical solutions and advantages of the present disclosure more clearly, the following clearly and completely describes the technical solutions in the embodiments of the present disclosure with reference to the accompanying drawings in the embodiments of the present disclosure. Apparently, the described embodiments are merely a part rather than all of the embodiments of the present disclosure. The components of the embodiments of the present disclosure generally described and illustrated in the drawings herein can be arranged and designed in a variety of different configurations. The following detailed description of the embodiments of the present disclosure provided in the accompanying drawings is not intended to limit the claimed scope of the present disclosure, but merely represents selected embodiments of the present disclosure. All other embodiments obtained by those of ordinary skill in the art based on the embodiments of the present disclosure without creative efforts shall fall within the scope of protection of the present disclosure.

Embodiment:

As shown in FIG. 1 to FIG. 10, a piling machine provided by the embodiment includes a portal frame 1, a pile frame platform 2, a moving assembly 3, and a lifting assembly 4. The portal frame 1 is erected at one side of the pile frame platform 2, a power head 10 capable of ascending and descending is installed on the portal frame 1, and the power head 10 can be detachably connected to one end of any drill pipe moved to a position below the power head. A loading zone is located at a position of the pile frame platform 2 at one side of the portal frame 1, and a projection of a central shaft of the power head 10 on the pile frame platform 2 is located in an extension direction of the loading zone. The moving assembly 3 is located at one side or each of both sides of the loading zone, multiple drill pipes are horizontally distributed on the moving assembly 3, and each drill pipe is perpendicular to a plane where the portal frame 1 is located. The moving assembly 3 is configured for moving on a horizontal plane in a direction parallel to the plane where the portal frame 1 is located, so as to convey the multiple drill pipes to the loading zone in turn. The lifting assembly 4 includes a picking part 40 for grasping the drill pipe at the loading zone. The lifting assembly 4 is configured for pivoting relative to the pile frame platform 2, so as to drive the drill pipe grasped by the picking part 40 to switch from a horizontal state to an upright state and to move to a position below the power head 10 in the pivoting process.

The piling machine provided by the embodiment is configured for the construction of a cast-in-place pile, and partially suitable for a cast-in-place pile with a long construction length. In order to reduce the height of the pile driver, a drilling tool suitable for the piling machine can be divided into multiple drill pipes, one of the multiple drill pipes is provided with a drill bit, which is regarded as an original drill pipe 5, and the rest are spare drill pipes 6. Prior to constructing the cast-in-place pile, the drilling tool satisfying a drilling depth can be selected according to the design length requirements of the cast-in-place pile first, and then the original drill pipe 5 with the drill bit of the drilling tool can be connected below the power head 10 on the portal frame 1, and the multiple spare drill pipes 6 of the drilling tool can be horizontally distributed on the moving assembly 3 in turn. It should be noted that although the portal frame 1 is erected on one side of the pile frame platform 2, and the original drill pipe 5 is connected below the power head 10 installed on the portal frame 1, as the pile frame platform 2 is further provided with the moving assembly 3 and multiple spare drill pipes 6 on the moving assembly 3 are horizontally distributed, a large number of erected drill pipes will not be accumulated at the portal frame 1 on the pile frame platform 2 in this case, the center of gravity of the pile driver is free of shifting to the portal frame 1, and meanwhile, the multiple spare drill pipes 6 horizontally distributed can play a role in balancing weight, thus effectively ensuring the balance stability of the piling machine.

Figure 2:
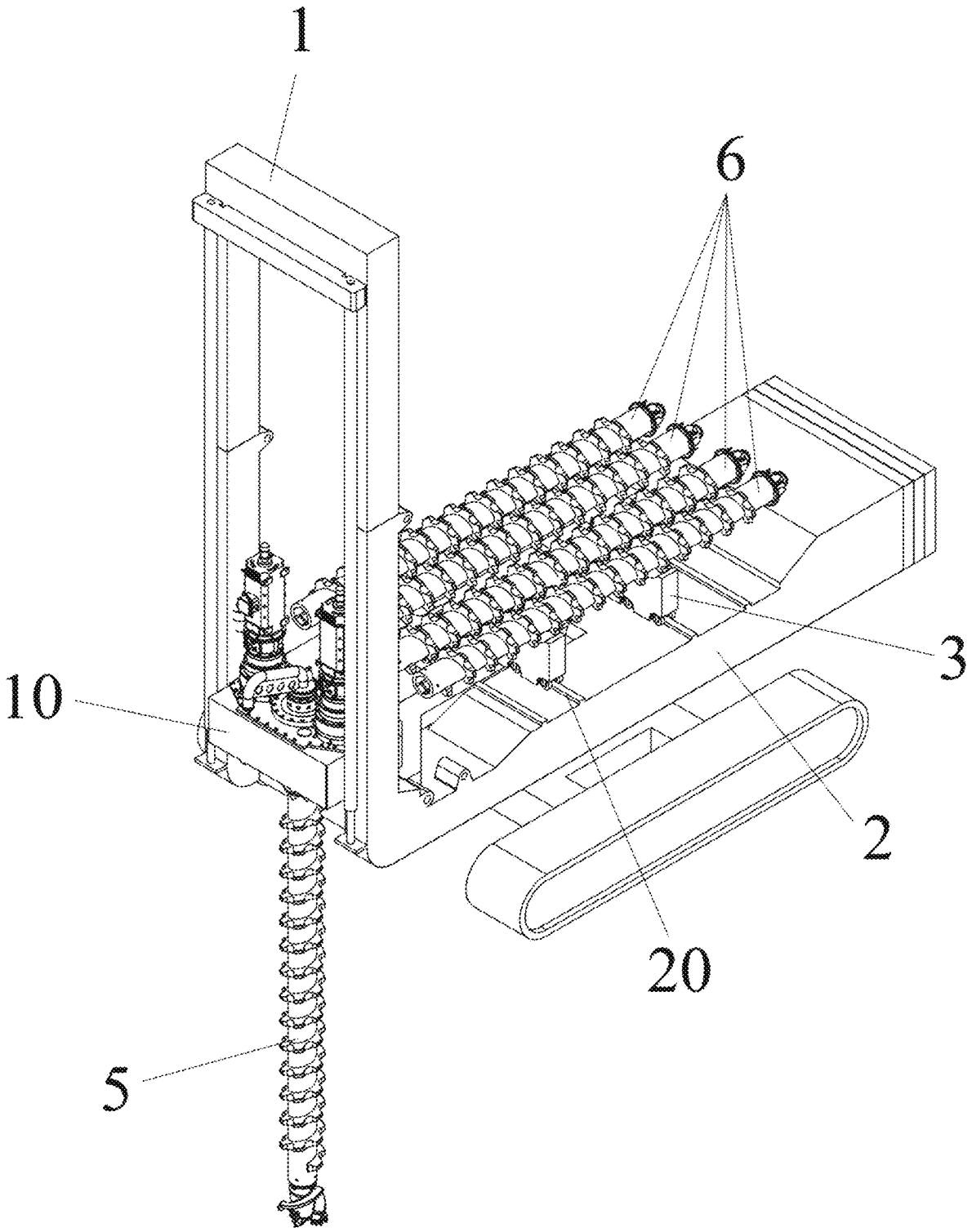
FIG. 2 is a structural schematic diagram of a piling machine according to Embodiment of the present disclosure with one of drill pipes being moved to a loading zone.
Figure 3:
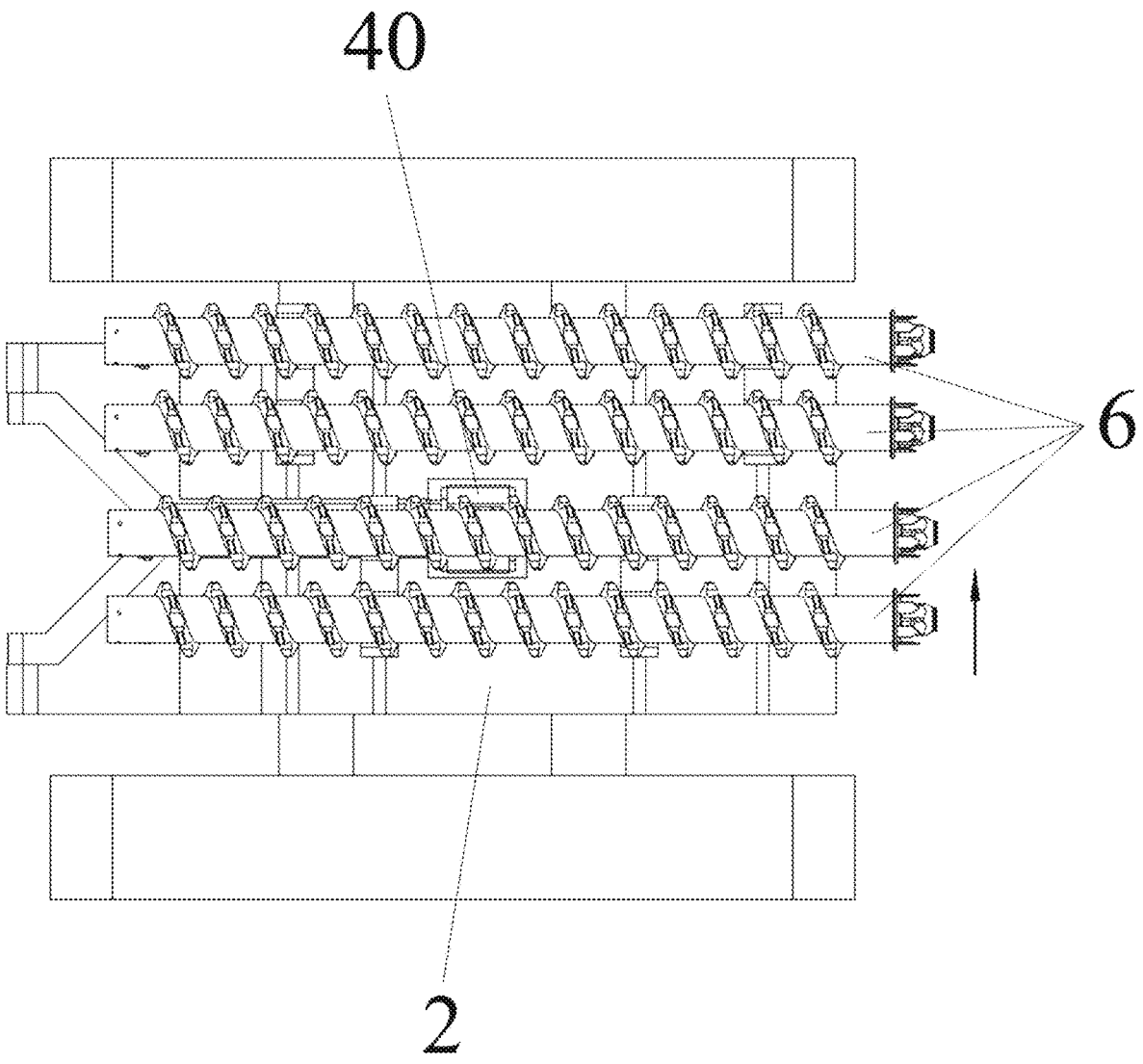
FIG. 3 is a top view of a pile frame platform and multiple spare drill pipes in FIG. 2.
Figure 5:
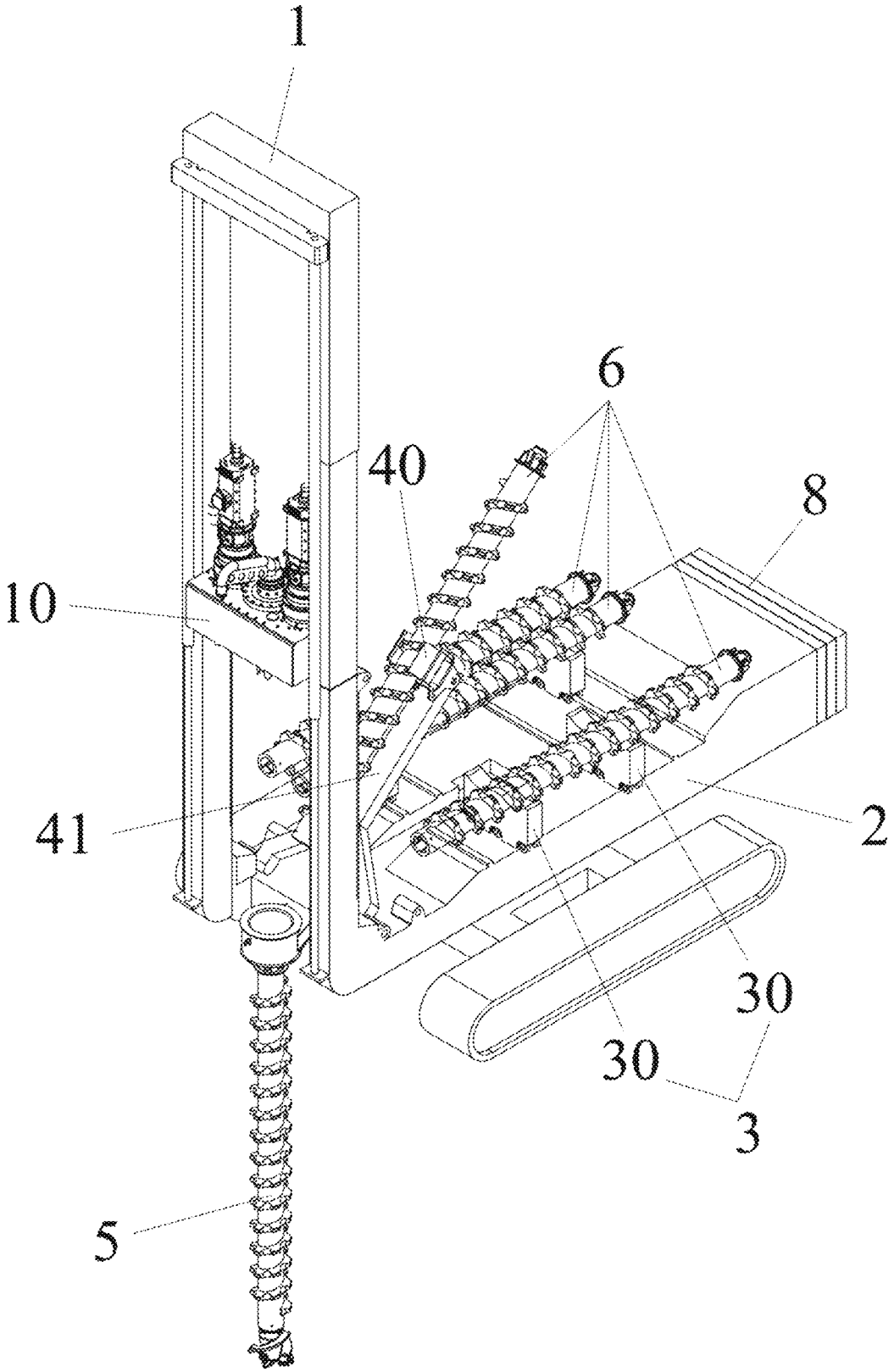
FIG. 5 is a structural schematic diagram of a piling machine according to an embodiment of the present disclosure when a lifting assembly pivots.
Figure 6:
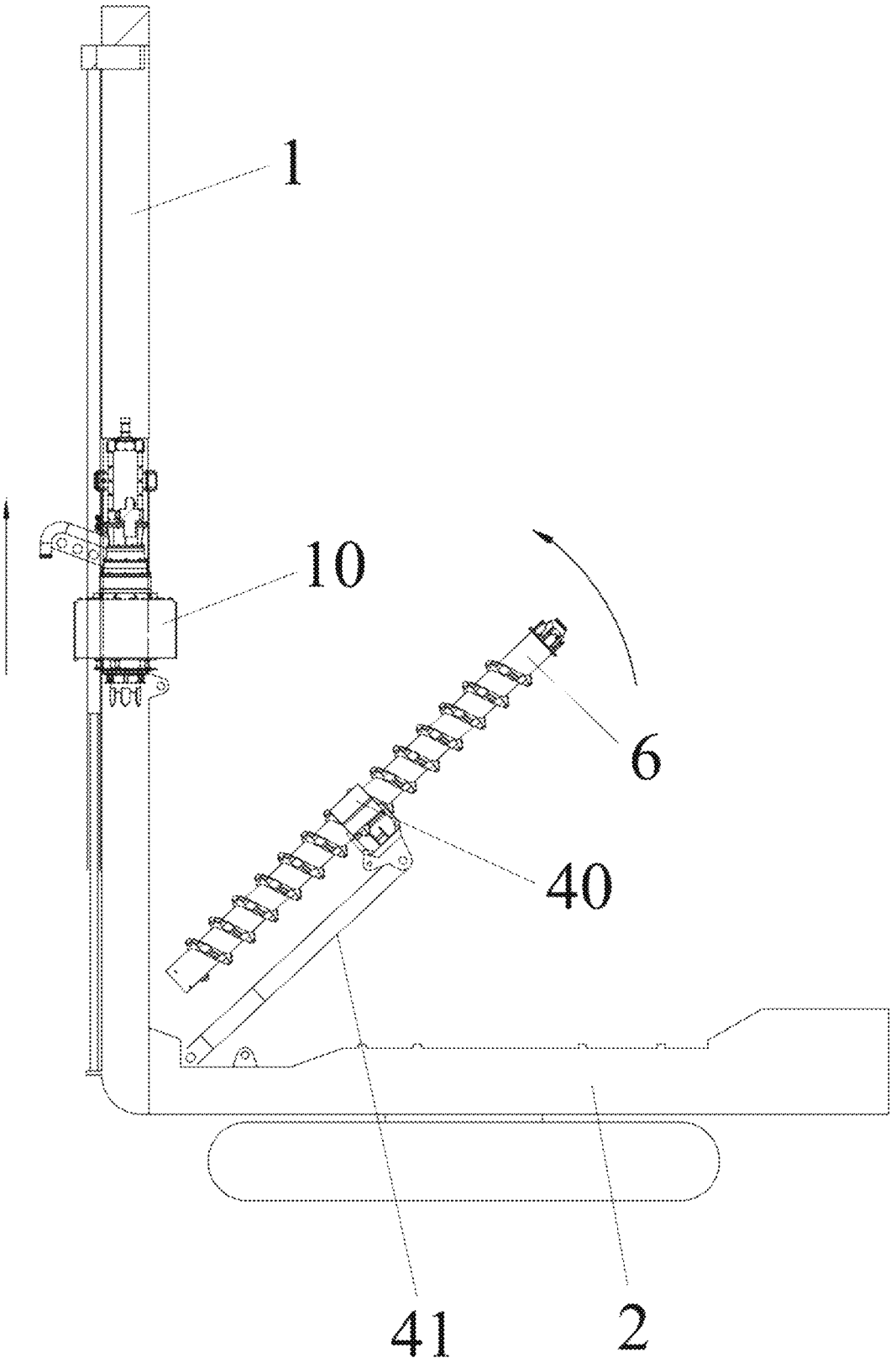
FIG. 6 is a side view of a piling machine according to an embodiment of the present disclosure when a lifting assembly pivots.
Figure 7:
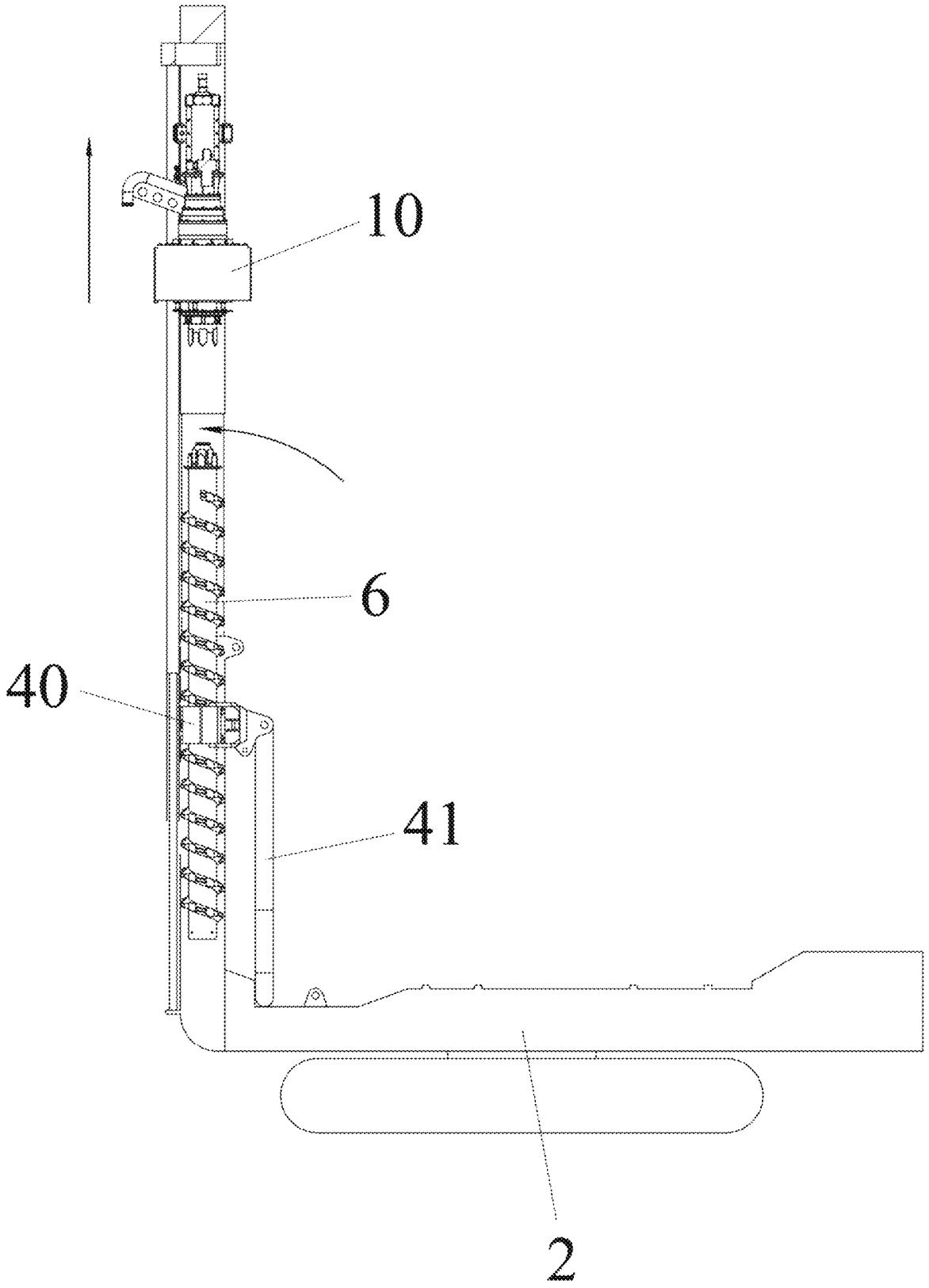
FIG. 7 is a side view of a piling machine according to an embodiment of the present disclosure when a lifting assembly pivots to be upright.
Figure 8:
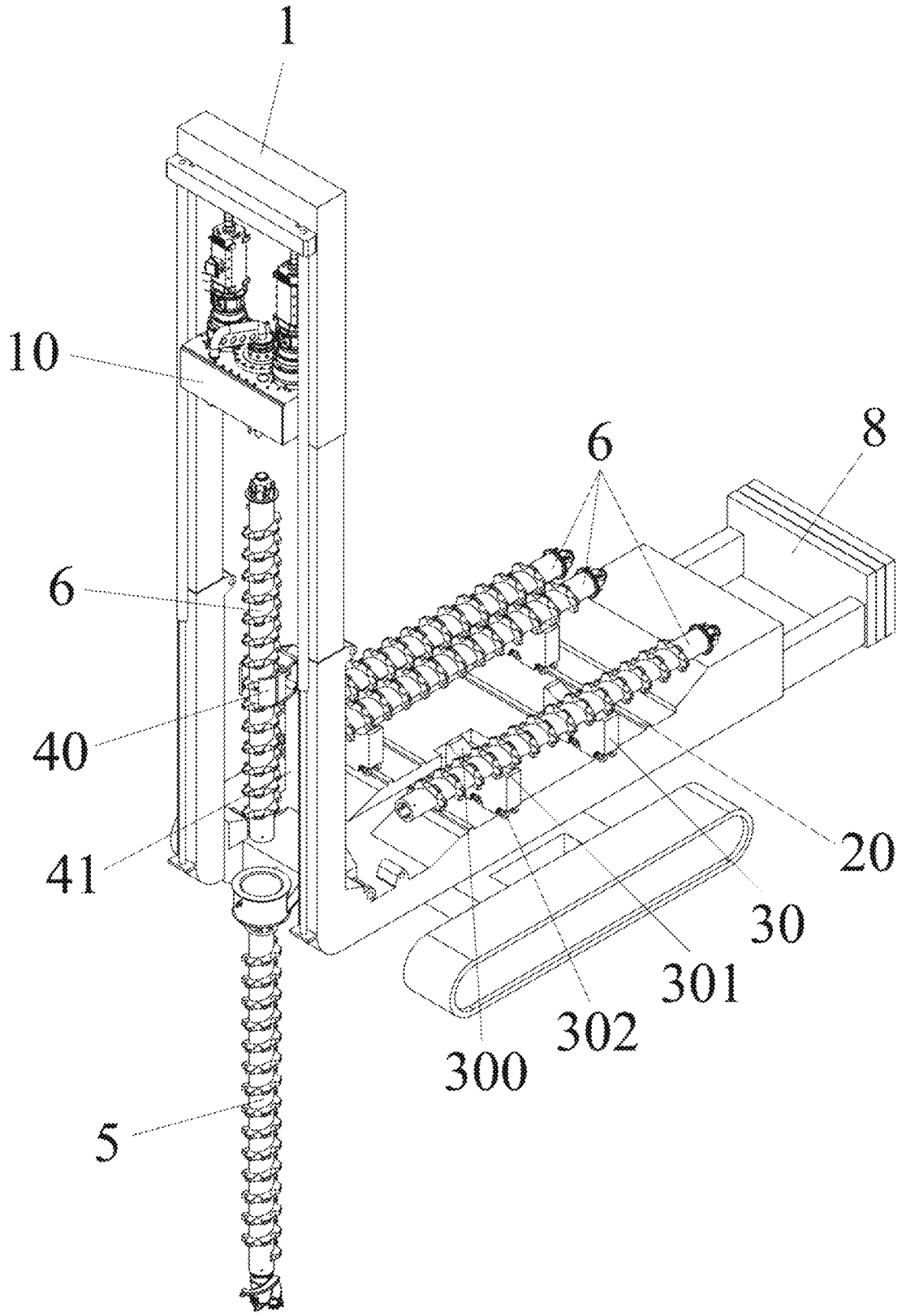
FIG. 8 is a structural schematic diagram of a piling machine according to an embodiment of the present disclosure when a spare drill pipe is erected below a power head.
Figure 9:
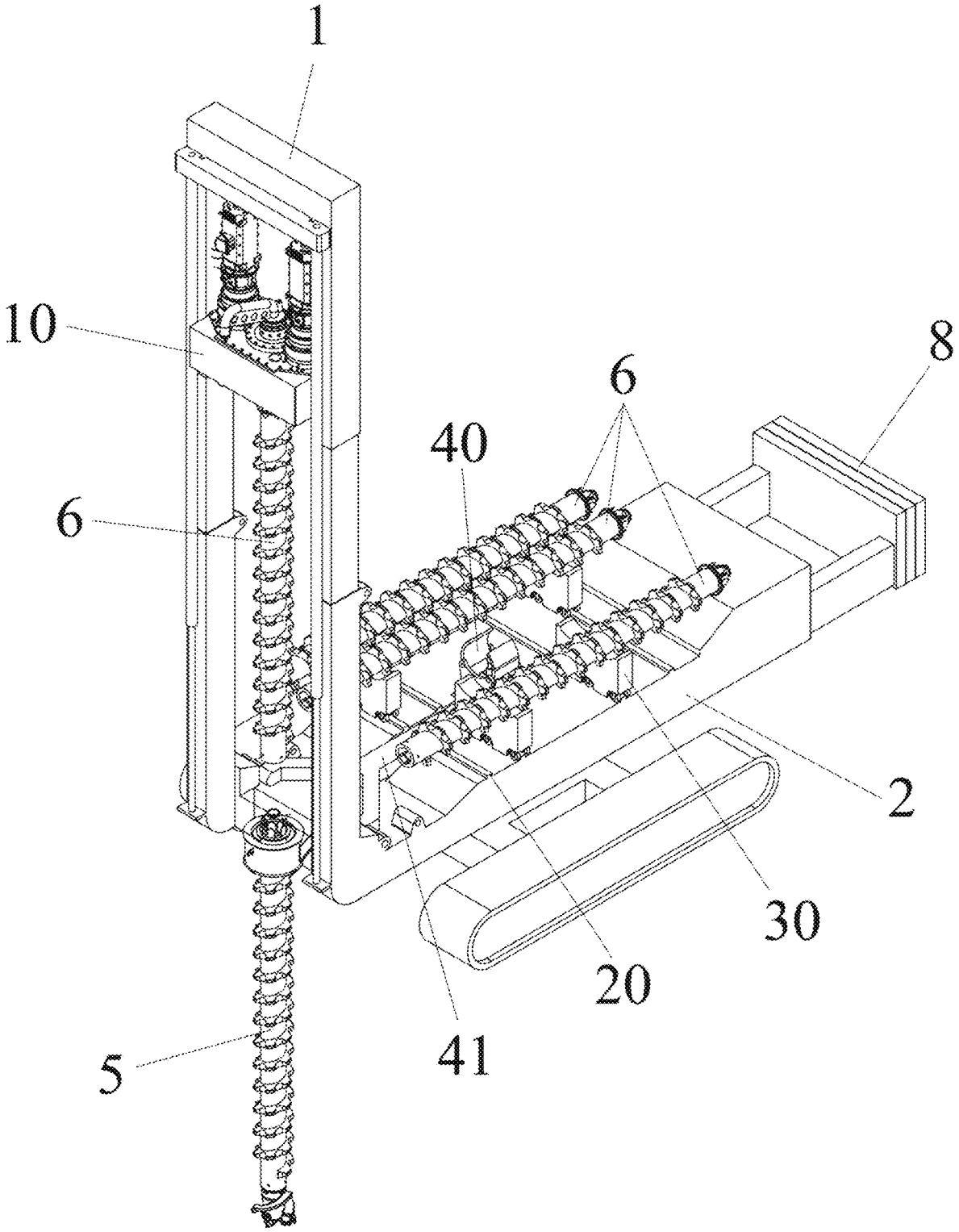
FIG. 9 is a structural schematic diagram of a piling machine according to an embodiment of the present disclosure when a spare drill pipe is connected below a power head.
Figure 10:
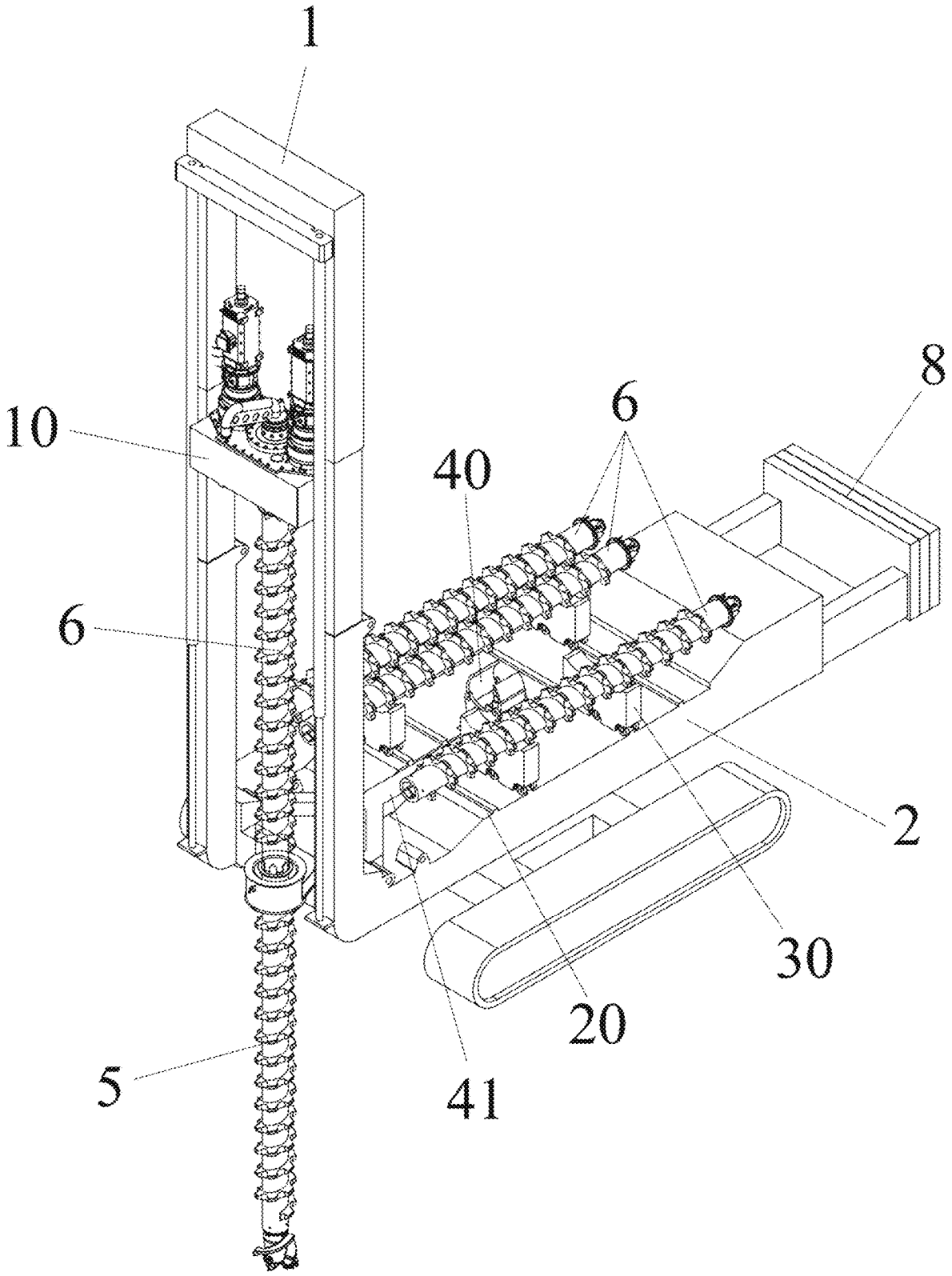
FIG. 10 is a structural schematic diagram of a piling machine according to an embodiment of the present disclosure when a power head drives a spare drill pipe to descend.

In the process of constructing a cast-in-place pile, the original drill pipe 5 and the spare drill pipes 6 need to be connected in turn to form a drilling tool satisfying the design length requirements of the cast-in-place pile. Specifically, the piling machine is moved to a construction area of the cast-in-placed pipe, and the power head 10 is located above a designed pile location of the cast-in-place pile, and then, as shown in FIG. 1 and FIG. 2, the power head 10 is lowered on the portal frame 1 and started, thus driving the original drill pipe 5 to rotate to drill into the soil at the designed pile location. As shown in FIG. 5 and FIG. 6, the power head 10 is separated from the original drill pipe 5 and raised to the original position on the portal frame 1, so as to be connected to the next spare drill pipe 6. In the process of driving the original drill pipe 5 to move by the power head, as shown in FIG. 2 and FIG. 3, it is necessary to move the moving assembly 3 horizontally on the pile frame platform 2 in a direction parallel to the plane where the portal frame 1 is located, so as to convey one of the spare drill pipes 6 to the loading zone. After the spare drill pipe 6 is moved to the loading zone, the picking part 40 of the lifting assembly 4 is started to grasp the spare drill pipe 6 at the loading zone. Then, as shown in FIG. 6 and FIG. 7, in the process of raising the power head 10 to the original position, the lifting assembly 4 is started to pivot relative to the pile frame platform 2, as the projection of the central shaft of the power head 10 on the pile frame platform 2 is in an extension direction of the loading zone, the spare drill pipe 6 grasped by the picking part 40 can be switched from a horizontal state to an upright state by pivoting the lifting assembly 4. Meanwhile, the spare drill pipe 6 is located below the power head 10 after being erected, as shown in FIG. 7 and FIG. 8. When the spare drill pipe 6 is in an upright state, the power head 10 is raised to the original position, as shown in FIG. 8 and FIG. 9. At this time, the power head 10 is lowered to be connected to the spare drill pipe 6 below. After the power head 10 is connected to the spare drill pipe 6 below, the picking part 40 is released and the lifting assembly 4 is driven to return to the original position as shown in FIG. 10, such that the power head 10 continues to descend until the spare drill pipe 6 connected below the power head 10 is moved to a top end of the original drill pipe 5. Afterwards, a bottom end of the spare drill pipe 6 is connected to the top end of the original drill pipe 5, and then the power head 10 is started to drive the spare drill pipe 6 and the original drill pipe 5 to rotate simultaneously, thus drilling the spare drill pipe 6 into the soil at the designed pipe location.

By repeating the above processes of moving the spare drill pipe 6, pivoting the spare drill pipe 6, connecting the spare drill pipe 6 to the power head 10, lowering the power head 10, connecting the spare drill pipe 6 to the original drill pipe 5, and drilling the spare drill pipe 6 into the soil, the multiple spare drill pipes 6 can be connected and drilled into the soil in turn, and thus a drilling tool formed by connecting the multiple drilling pipes can be drilled into the soil at the designed pile location of the cast-in-place pile. The drilling tool can satisfy the design length requirements of the cast-in-place, and can be used in constructing the cast-in-place pile.

Figure 4:
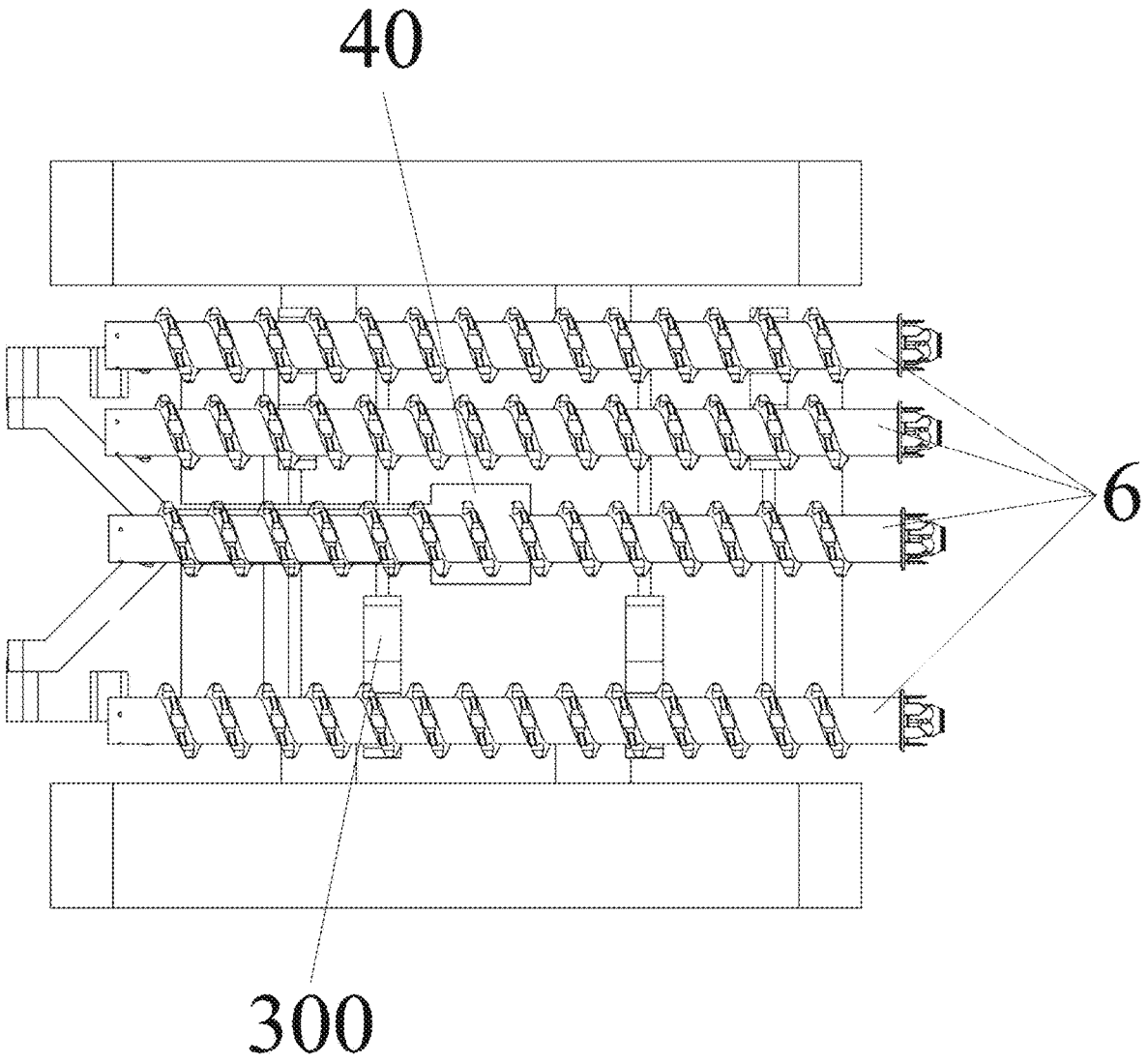
FIG. 4 is a top view of a pile frame platform and multiple spare drill pipes after a moving assembly in FIG. 2 returns to an original position.

After the picking part 40 grasps the spare drill pipe 6 at the loading zone, in order to prevent the lifting assembly 4 and the moving assembly 3 from interfering with each other in the subsequent process of moving the spare drill pipe 6, as shown in FIG. 4 and FIG. 5, the moving assembly 3 can be reversely moved back to the original position, and then the lifting assembly 4 is started to pivot relative to the pile frame platform 2.

It should be noted that in the process of connecting the multiple spare drill pipes 6 in turn, the horizontally distributed spare drill pipes 6 that have not moved to the loading zone on the pile frame platform 2 can continue to play the role of counterweight to ensure the balance and stability of the piling machine. Meanwhile, because each spare drill pipe 6 will be driven into the soil after being connected, the weight at the portal frame 1 is free of increasing continuously with the progress of the pipe connecting operation. Even if the pipe connecting operation enters the later stage, and there are no horizontal spare drill pipes 6 distributed on the pile frame platform, the center of gravity of the piling machine is still free of shifting to the portal frame, and the stability of the piling machine can still be guaranteed.

It also should be noted that no matter a connection process between the original drill pipe 5 and the power head 10, the connection process between the spare drill pipe 6 and the power head 10, or the connection process between two adjacent drill pipes, manual connection or automatic connection can be adopted.

The automatic connection mode may be achieved using a connector assembly with an elastic pin. Specifically, the connector assembly includes a male connector and a female connector, one of which is provided with an elastic pin and the other is provided with a slot. When the male connector and the female connector are butted, the elastic pin can be automatically inserted into the slot, and the elastic pin can be withdrawn from the slot when pressed under the action of an external force, and at this time, the male connector and the female connector can be separated from each other. Further, each of the power head 10 and the bottom end of the spare drill pipe 6 may be provided with the female connector, and the top end of each drill pipe may employ the male connector. When the spare drill pipe 6 is horizontally placed on the moving assembly 3, the male connector of the spare drill pipe 6 perpendicular to the plane where the portal frame 1 is arranged adjacent to the portal frame 1, and the female connector of the spare drill pipe 6 can be arranged far away from the portal frame 1.

In addition, in order to improve the connection accuracy between the power head 10 and the spare drill pipe 6, the power head 10 may be provided with a positioning part 100, the positioning part 100 is configured to abut against a circumferential side wall of the spare drill pipe 6 to limit the spare drill pipe 6 when the spare drill pipe 6 is erected below the power head 10, and thus the spare drill pip 6 can be stably located below the power head 10.

Compared with the prior art, by horizontally placing multiple drill pipes on the orderly moving assembly 3 and grasping and lifting each drill pipe point-to-point through the lifting assembly 4, the multiple drill pipes horizontally placed at different stations can be sent to the same position (below the power head 1) in the portal frame 1 in turn by a single stroke route of the lifting assembly 4, such that the processes of conveying the drill pipes, connecting drill pipes and drilling the drill pipes into the soil can be carried out completely and orderly. Meanwhile, the piling machine can balance the pile driver by horizontally distributing multiple drill pipes on the moving assembly 3, so as to ensure the stability of the piling machine. In the process of connecting the drill pipes, the center of gravity of the piling machine can be kept from shifting to the portal frame 1 by using the process of drilling the drill pipes into the soil after the drill pipes are connected and the horizontally distributed drill pipes that have not been connected, so as to keep the use stability of the piling machine.

As can be seen from the embodiment that the piling machine may achieve the ordered placement of the spare drill pipes 6, and thus the spare drill pipes 6 can be safely, stably and reliably located on the piling machine, without causing the center of gravity of the piling machine to shift and overturn. Meanwhile, as the moving assembly 3 can move along a simple route on the pile frame platform 2, each spare drill pipe 6 can be automatically moved to the loading zone and aligned with the picking part 40 of the lifting assembly 4, and then the spare drill pipe 6 can be switched from the horizontal state to the upright state and located below the power head 10 through a pivoting action of the lifting assembly 4. Therefore, the piling machine provided by this embodiment can complete the work of taking, conveying and connecting the drill pipes through three simple continuous actions of orderly placing the drill pipes horizontally, moving the drill pipes horizontally and pivoting the drill pipes. The problems of poor stability and not smoothly connecting the pipes of the existing pile driver are overcome.

In this embodiment, a vertical force applying mechanism for driving the power head 10 to ascend or descend may be installed on the portal frame 1. The vertical force applying mechanism may employ an air cylinder, an oil cylinder and other telescopic driving devices. It should be noted that the structure of the vertical force applying mechanism is not limited, which may employ any device capable of driving the power head 10 to ascend and descend. For example, the vertical force applying mechanism may also employ a chain device, or a winch device.

As shown in FIG. 1, in the embodiment, the portal frame 1 in the piling machine may employ a portal structure, and include two upright columns arranged in parallel and a beam perpendicularly connected between the two upright columns. The plane where the portal frame 1 is located is the plane where the two uprights and the beam are located.

Further, each upright column of the portal frame 1 may be formed by slidably connecting a fixed rod 11 and a lifting rod 12, and the power head 10 is fixedly connected to the lifting rod 12. The vertical force applying mechanism may be installed on the portal frame 1, an output end of the vertical force applying mechanism is connected to the power head 10. The vertical force applying mechanism is configured for driving the power head 10 to ascend or descend, and meanwhile, the lifting rod 12 can be driven by the power head 10 to vertically slide on the fixed rod 11. In this case, the fixed rod 11 and the lifting rod 12 may form a slide rail structure, thus effectively improving the lifting stability of the power head 10 on the portal frame 1.

In this embodiment, in order to facilitate the movement of the piling machine, a traveling assembly 7 may also be installed at the bottom of the pile frame platform 2. Further, in this embodiment, the traveling assembly 7 is preferably a crawler traveling mechanism or a walking-frame traveling mechanism. In order to improve the supporting strength of the pile frame platform 2 in the piling machine, in this embodiment, the pile frame platform 2 preferably includes a housing, and a supporting structure installed in the housing. The supporting structure is formed by connecting multiple force-bearing rod members.

As shown in FIG. 1, FIG. 11, FIG. 12 and FIG. 21, the moving assembly 3 includes multiple sliding mechanisms 30, and the multiple sliding mechanisms 30 are distributed at intervals in a direction perpendicular to the plane where the portal frame 1 is located, and configured for supporting the multiple drill pipes and moving the multiple drill pipes. In the direction perpendicular to the plane where the portal frame 1 is located, the picking part 40 at the loading zone and the multiple sliding mechanisms 30 are distributed in a staggered manner.

As shown in FIG. 11, FIG. 12, FIG. 13 and FIG. 14, the sliding mechanism 30 can move on the pile frame platform 2 in a direction parallel to the plane where the portal frame 1 is located under the driving of an external force, and at this time, by adjusting a moving stroke of the sliding mechanism 30, the sliding mechanism 30 can accurately convey the spare drill pipe 6 to be connected thereon to the loading zone.

It should be noted that when multiple sliding mechanisms 30 are provided, and each sliding mechanism 30 is configured for supporting multiple spare drill pipes 6, each spare drill pipe 6 can be accurately moved to the loading zone by adjusting the moving stroke of the sliding mechanism 30.

It also should be noted that the picking part 40 at the loading zone and the multiple sliding mechanisms 30 are distributed in a staggered manner in the direction perpendicular to the plane where the portal frame 1 is located, which can prevent a situation that the spare drill pipe 6 is hard to be moved in place due to the mutual obstruction between the picking part 40 and the sliding mechanisms 30.

Figure 11:
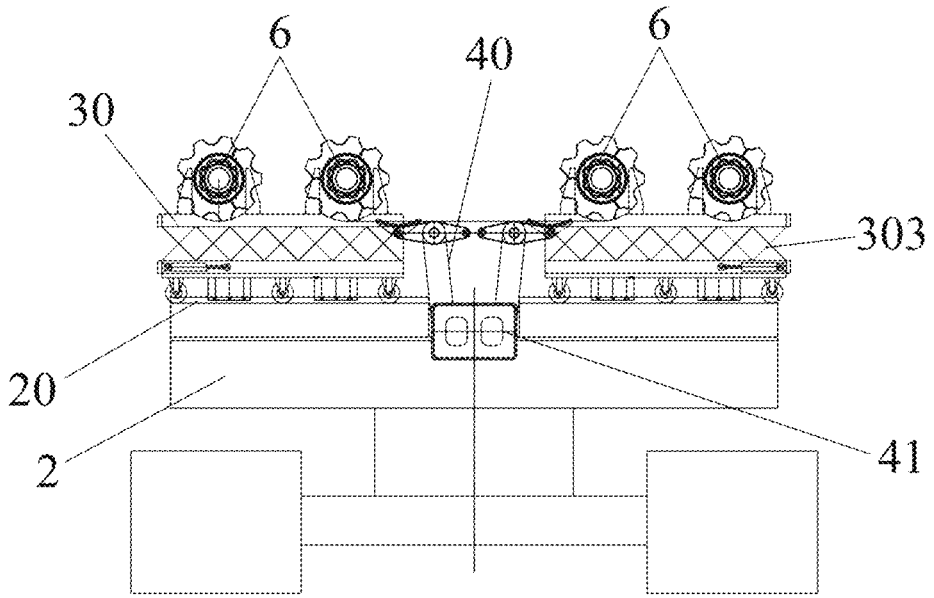
FIG. 11 is a sectional view of a moving assembly, a lifting assembly and spare drill pipes according to an embodiment of the present disclosure.
Figure 12:
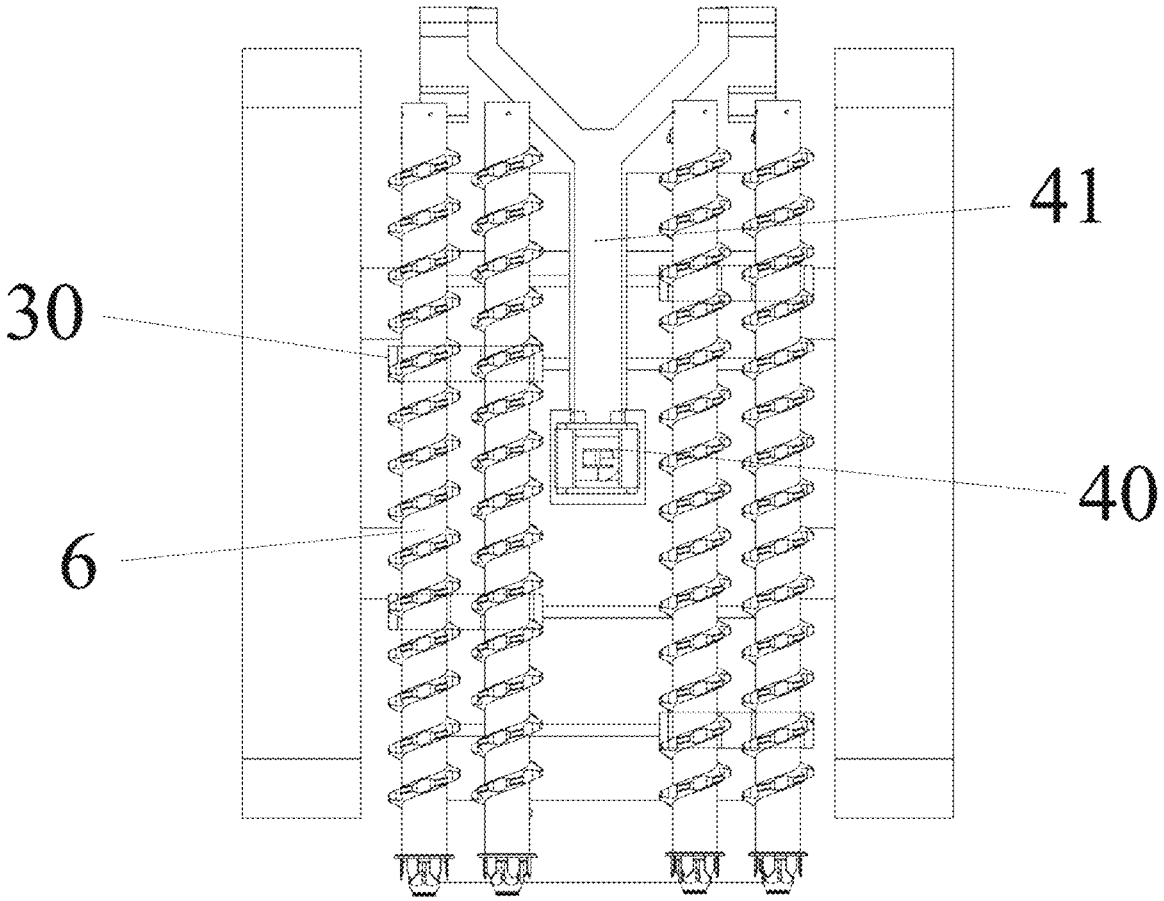
FIG. 12 is a top view of a moving assembly, a lifting assembly and spare drill pipes in FIG. 11.
Figure 13:
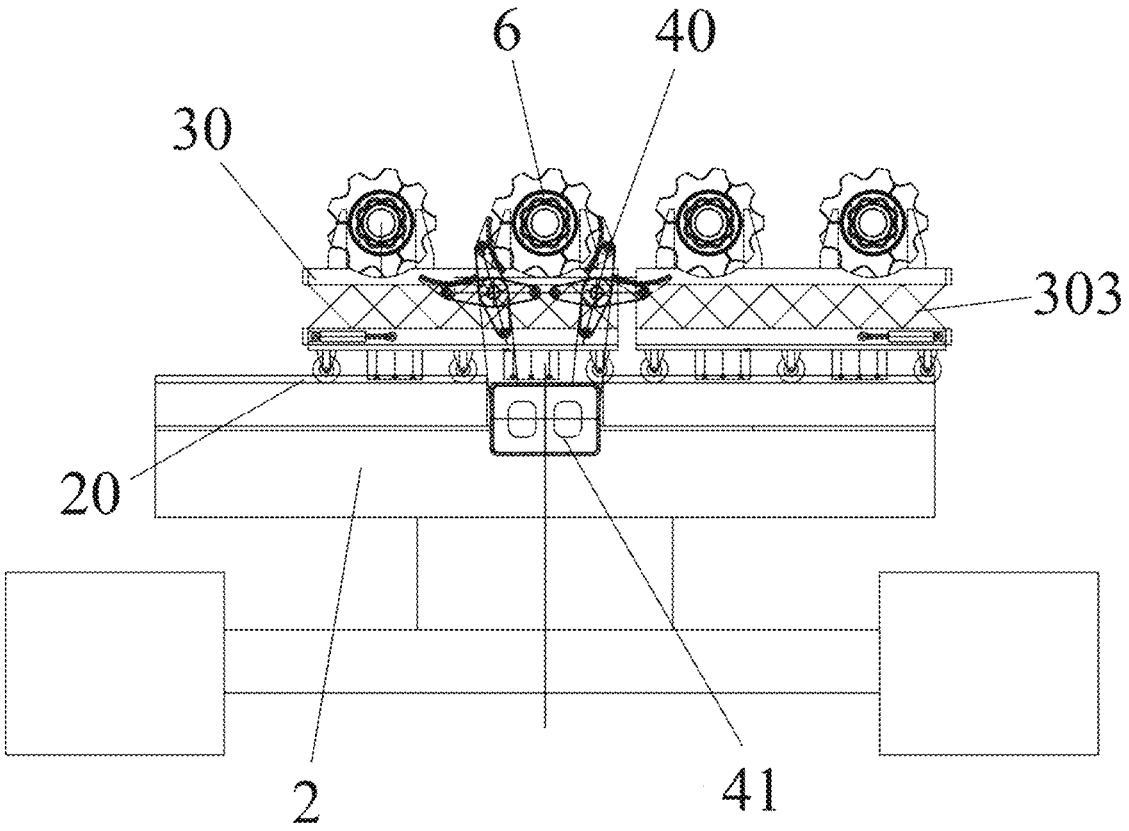
FIG. 13 is a sectional view of a moving assembly, a lifting assembly and spare drill pipes according to an embodiment of the present disclosure when one of the spare drill pipes is moved to a loading zone.
Figure 14:
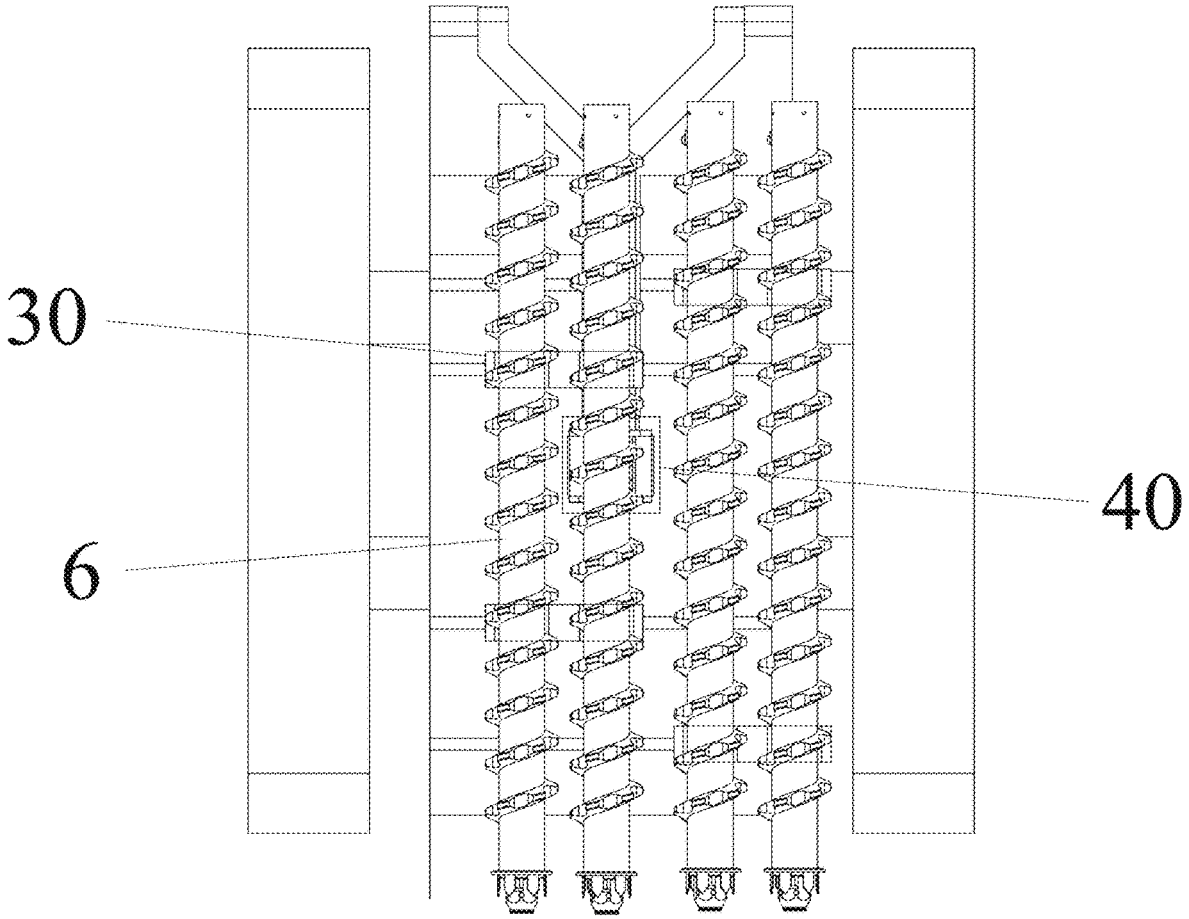
FIG. 14 is a top view of a moving assembly, a lifting assembly and spare drill pipes in FIG. 13.

In addition, in order to prevent the spare drill pipe 6 on the sliding mechanism 30 moved to the loading zone and the picking part 40 from interfering with each other, as shown in FIG. 11, the top of the picking part 40 in an open state is lower than the spare drill pipe 6. As shown in FIG. 13, when the sliding mechanism 30 moves the spare drill pipe 6 to the loading zone, the picking part 40 is closed to grasp the spare drill pipe 6 above.

Figure 15:
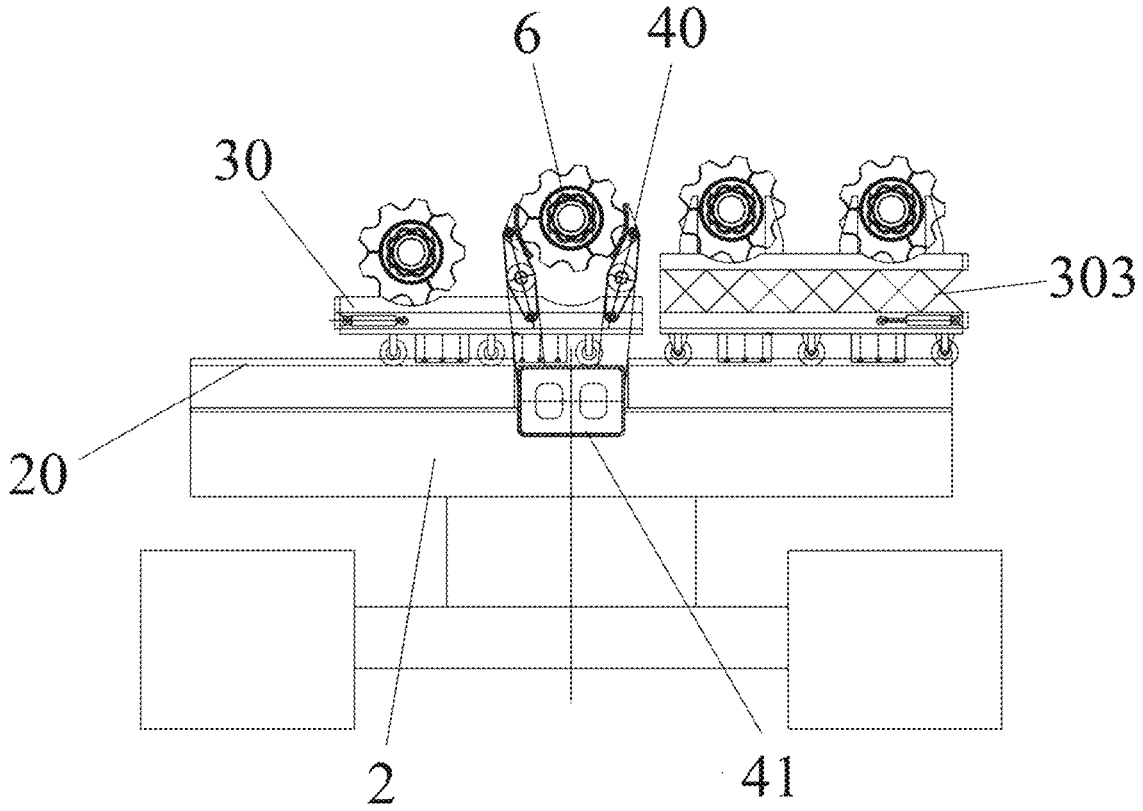
FIG. 15 is another sectional view of a moving assembly, a lifting assembly and spare drill pipes according to an embodiment of the present disclosure.
Figure 16:
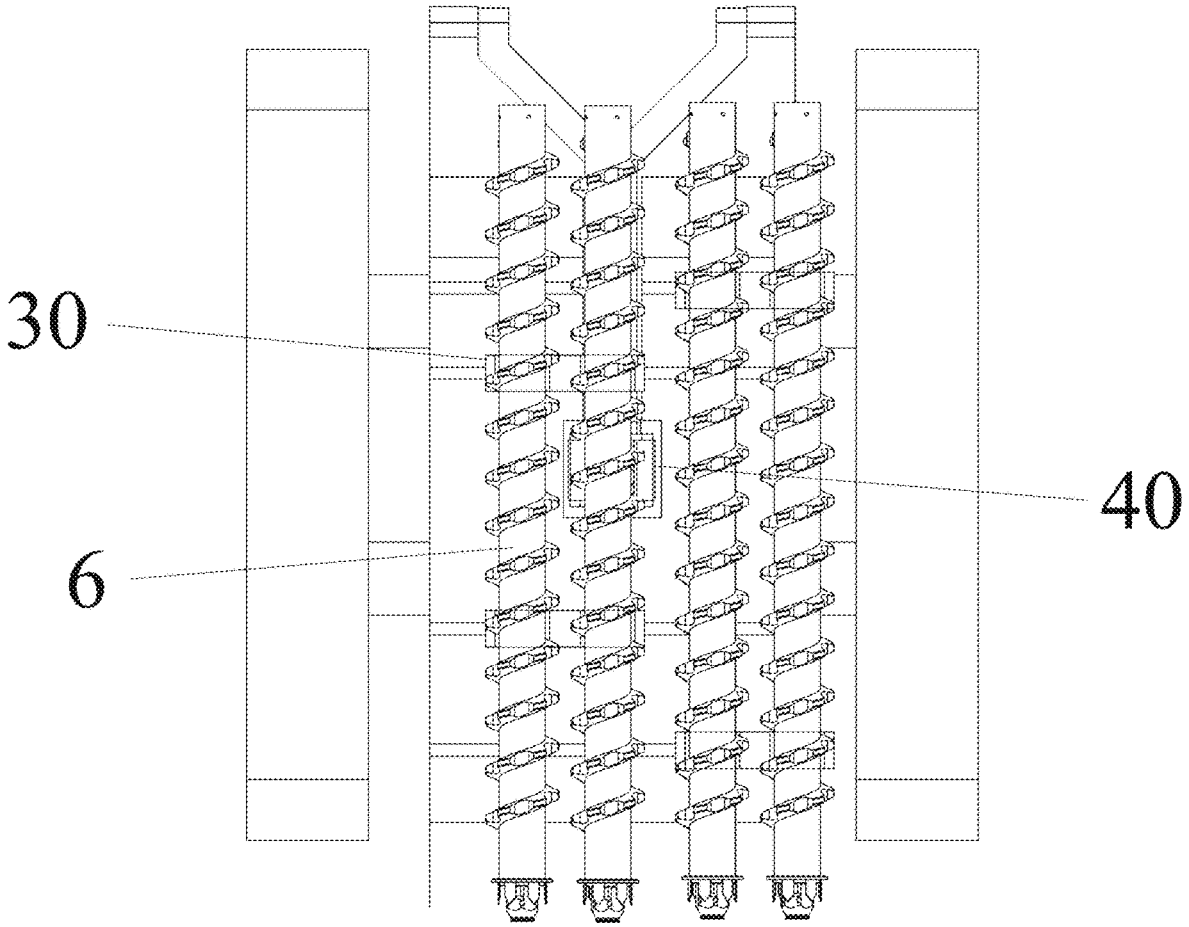
FIG. 16 is a top view of a moving assembly, a lifting assembly and spare drill pipes in FIG. 15.

As shown in FIG. 13 and FIG. 15, the sliding mechanism 30 is of a telescopic structure, and configured for driving the supported drill pipe to ascend and descend in the process of extending and retracting the sliding mechanism 30. The sliding mechanism 30 may be in an extending state in the process of supporting and conveying the spare drill pipe 6. After the spare drill pipe 6 is conveyed to the loading zone by the sliding mechanisms 30 and the picking part 40 grasps the spare drill pipe 6, as shown in FIG. 15 and FIG. 16, the sliding mechanism 30 may be retracted to descend, and at this time, a clearance is formed between the sliding mechanism 30 and the spare drill pipe 6 grasped by the picking part 40, which is easy for the sliding mechanism 30 to slide back to the original position. It can be seen that when the sliding mechanism 30 is of a telescopic structure, it is convenient for the sliding mechanism 30 to return to the original position after conveying the spare drill pipe 6 in place.

Figure 17:
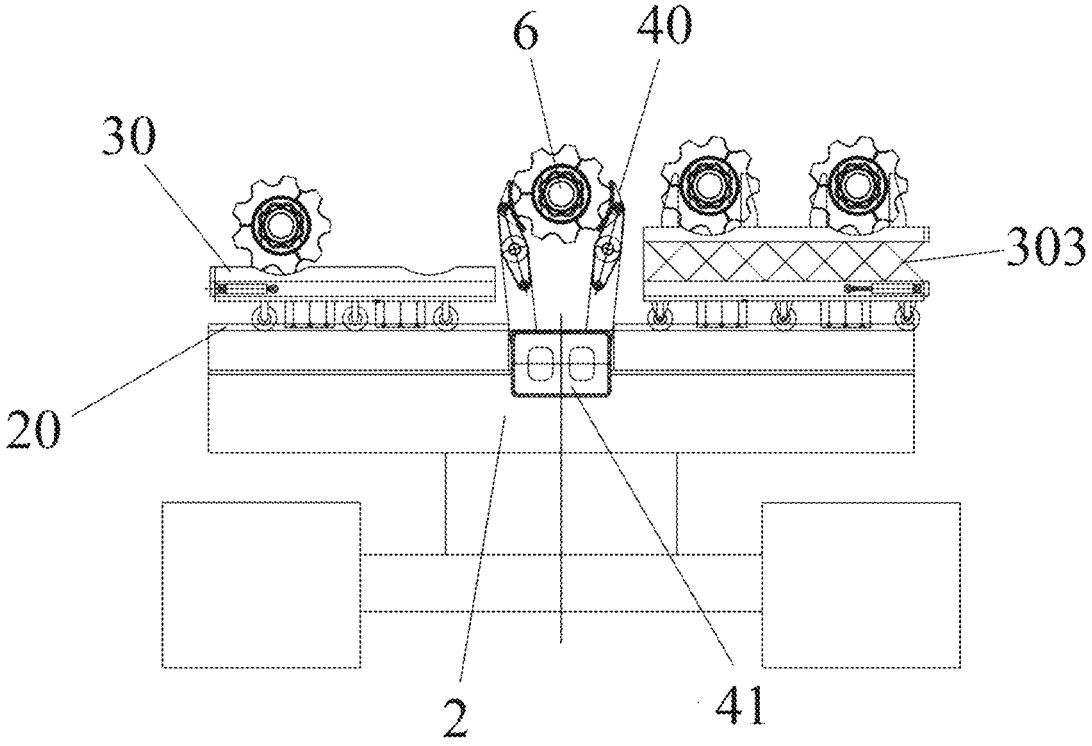
FIG. 17 is still another sectional view of a moving assembly, a lifting assembly and spare drill pipes according to an embodiment of the present disclosure.
Figure 18:
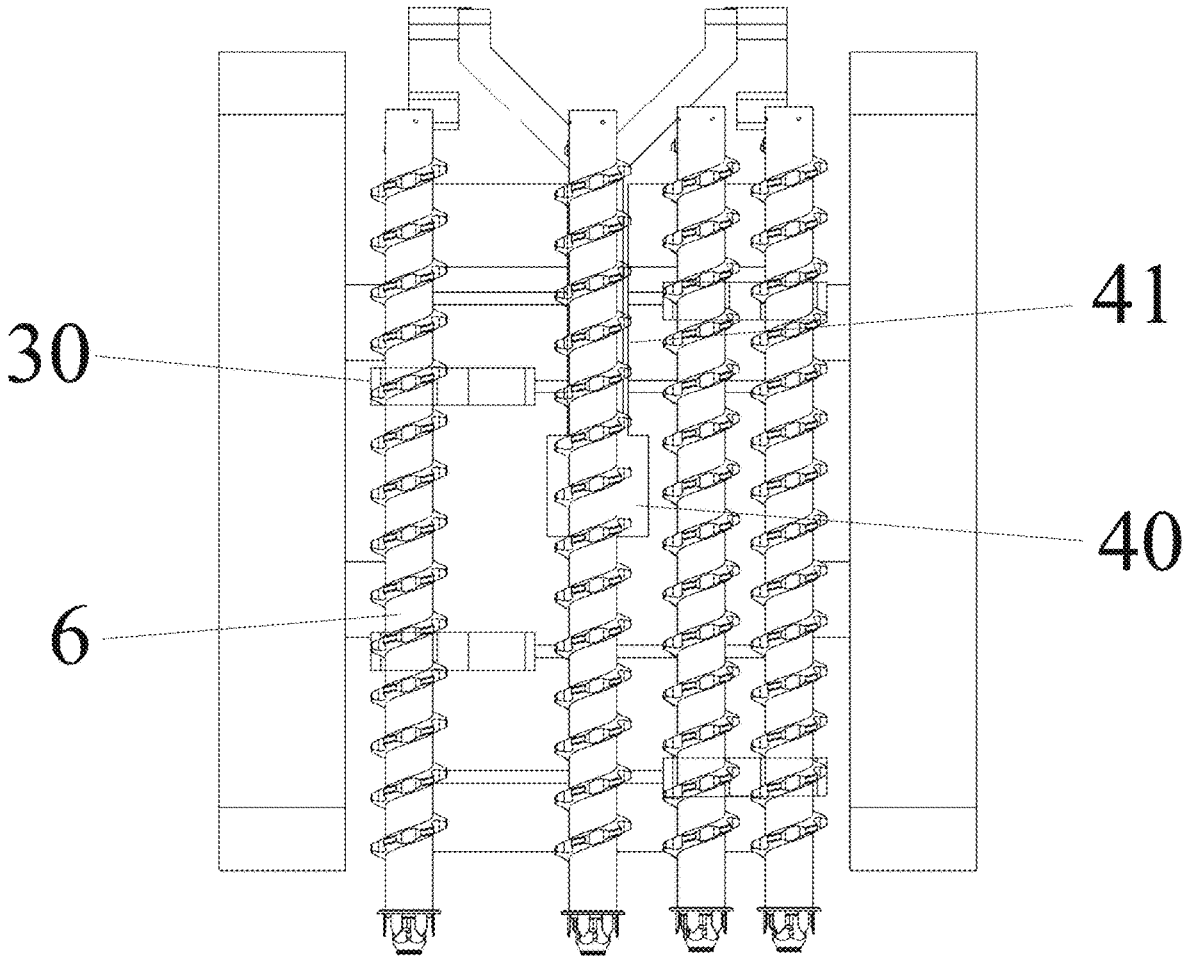
FIG. 18 is a top view of a moving assembly, a lifting assembly and spare drill pipes in FIG. 17.
Figure 19:
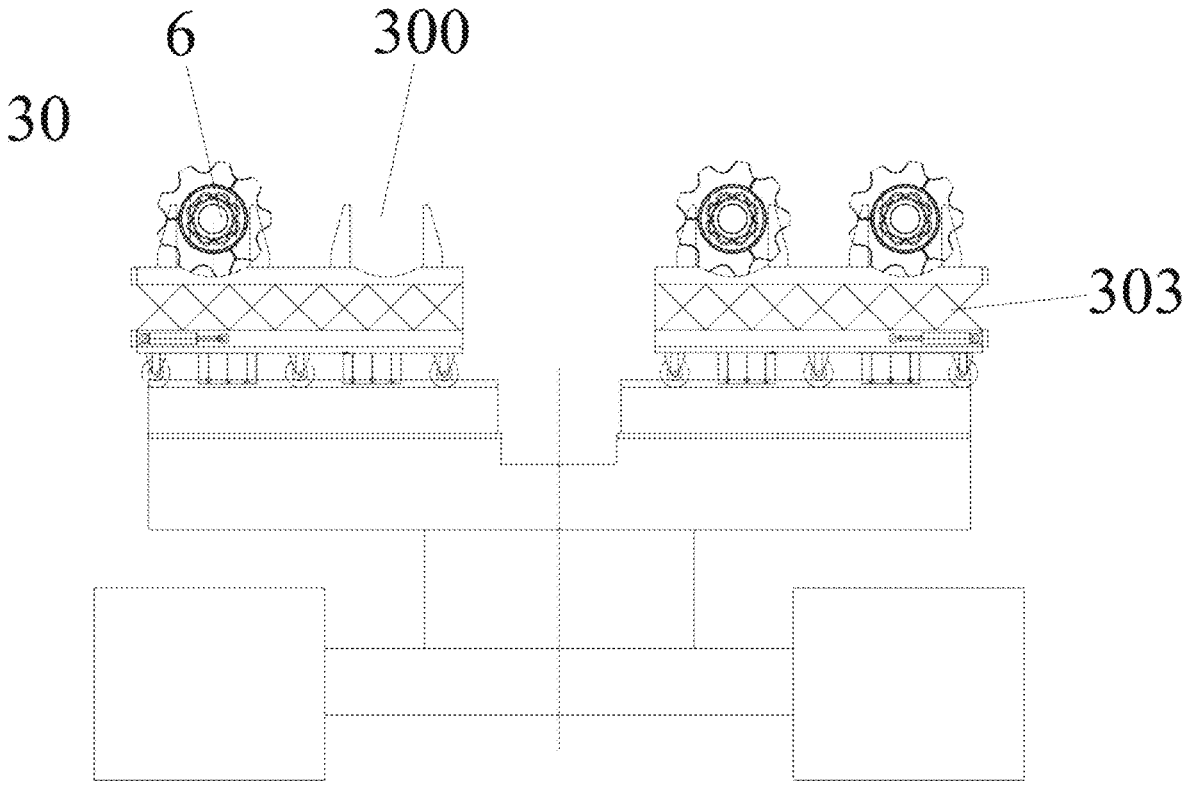
FIG. 19 is further another sectional view of a moving assembly, a lifting assembly and spare drill pipes according to an embodiment of the present disclosure.
Figure 20:
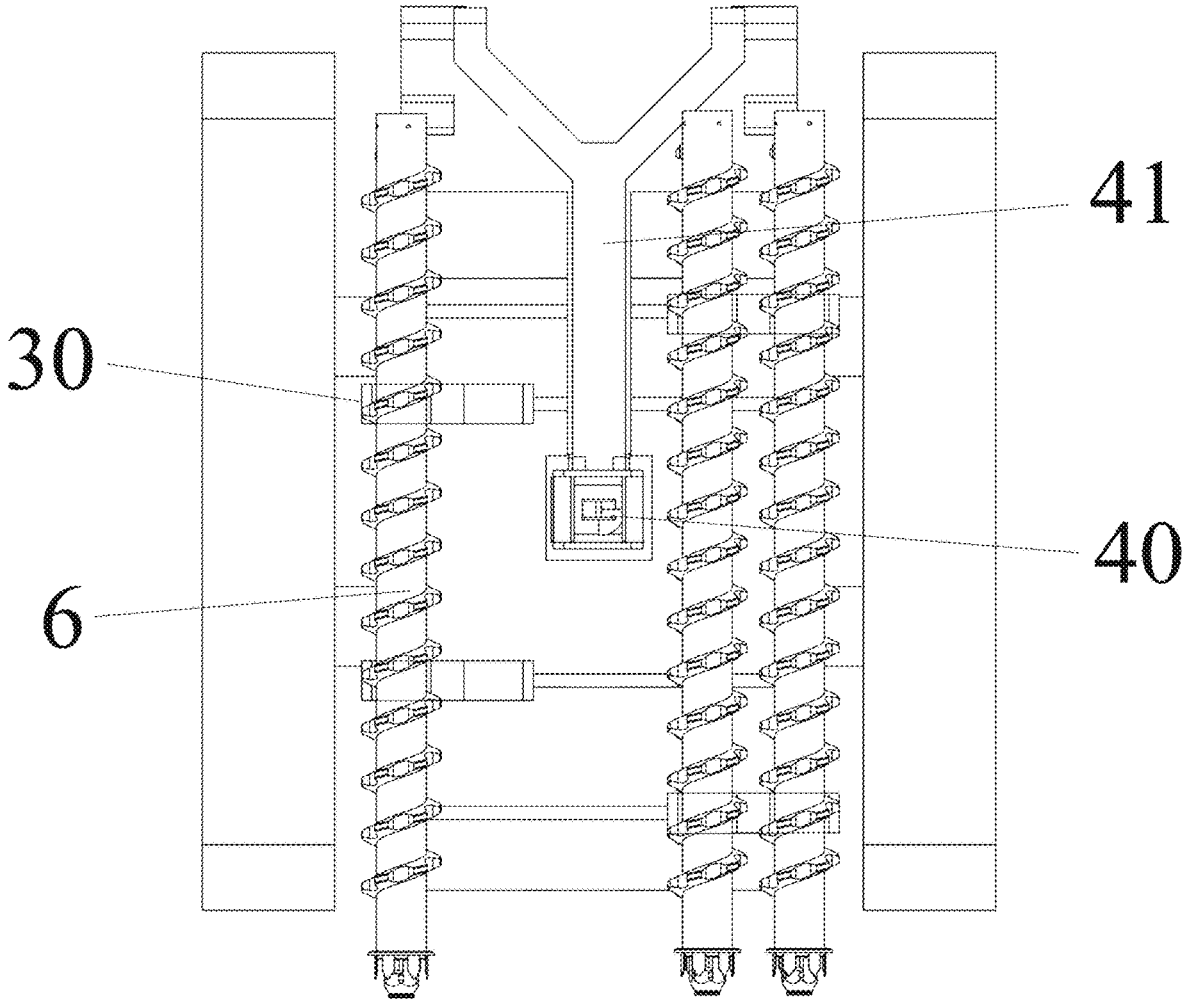
FIG. 20 is a top view of a moving assembly, a lifting assembly and spare drill pipes in FIG. 19.

As shown in FIG. 17 and FIG. 18, when the sliding mechanism 30 reversely moves to return to the original position, the sliding mechanism 30 may still be maintained at a retracted state. When the sliding mechanism 30 moves to the original position, as shown in FIG. 19 and FIG. 20, the sliding mechanism 30 needs to extend to convey the next spare drill pipe 6.

Figure 21:
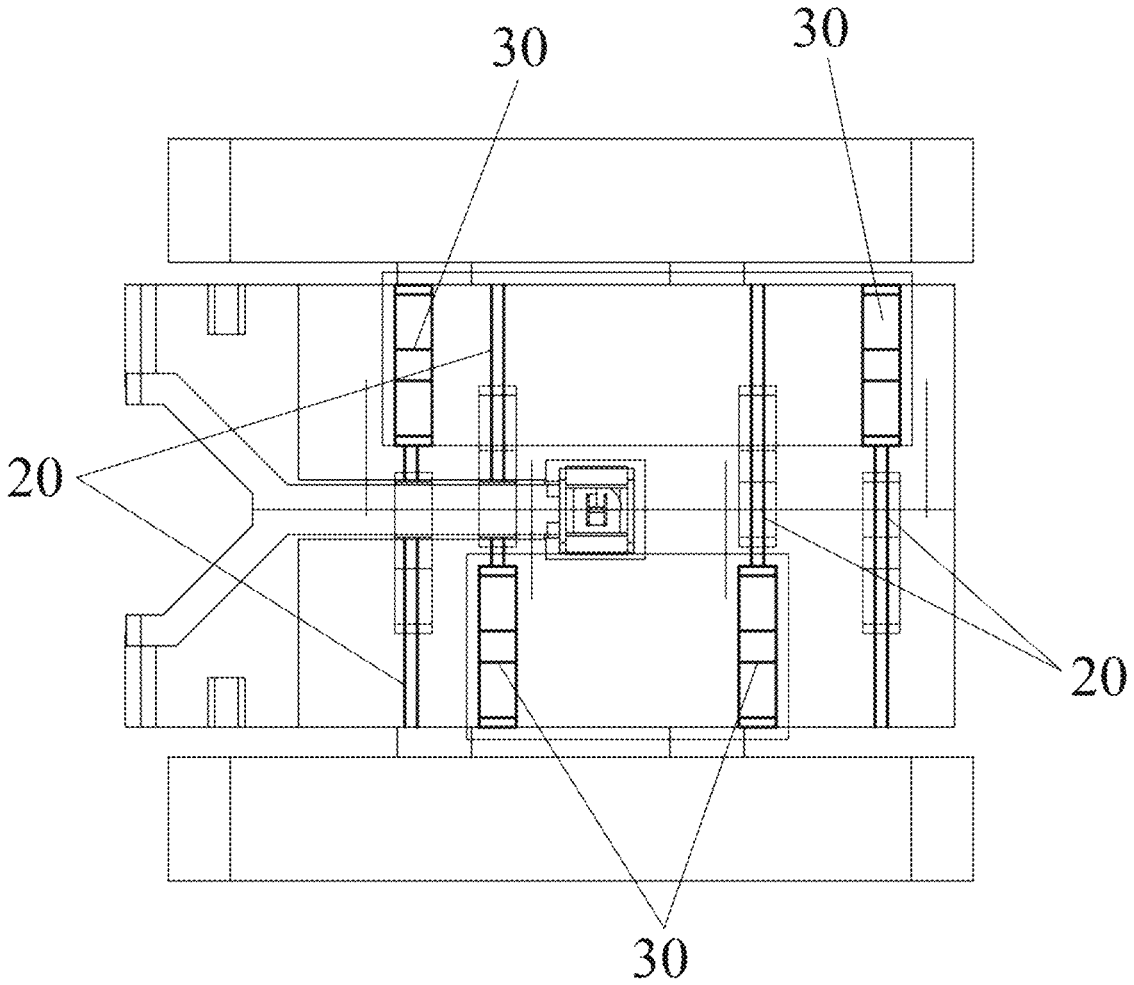
FIG. 21 is a top view of a moving assembly, a lifting assembly and a pile frame platform according to an embodiment of the present disclosure.

As shown in FIG. 1 and FIG. 21, the pile frame platform 2 is provided with multiple guide rails 20, the multiple guide rails 20 are distributed at intervals in the direction perpendicular to the plane where the portal frame 1 is located, and each guide rail 20 extends in a direction parallel to the plane where the portal frame 1 is located. The multiple sliding mechanisms 30 are slidably connected to the multiple guide rails 20 in one-to-one correspondence.

The guide rail 20 not only can limit a moving direction of the sliding mechanism 30, but also can reduce the friction between the sliding mechanism 30 and the pile frame platform 2, thus improving the moving smoothness of the sliding mechanism 30.

Further, the number of moving assemblies 3 is even, and the even number of moving assemblies 3 are divided into two groups, and the two groups of moving assemblies 3 are symmetrically distributed on both sides of the loading zone. When the even number of moving assemblies 3 are symmetrically distributed, the distribution of the moving assemblies 3 can be more orderly and uniform, and the distribution of the spare drill pipes 6 are more orderly and uniform, thus effectively improving the counterweight balance of the piling machine.

As shown in FIG. 1, each sliding mechanism 30 is provided with a first clamping position 300 and a second clamping position 301 distributed at an interval. The first clamping positions 300 of the multiple sliding mechanisms 30 are distributed in a straight line so as to support a drill pipe, and second clamping positions 301 of the multiple sliding mechanisms 30 are distributed on an other straight line to support an other drill pipe.

The first clamping positions 300 on the multiple sliding mechanisms 30 are configured for supporting a spare drill pipe 6, and the second clamping positions 301 on the multiple sliding mechanisms 30 are configured for supporting another spare drill pipe 6, and at this time, each moving assembly 3 can support two drill pipes.

As shown in FIG. 1, the sliding mechanism 30 may employ a slider with a pulley 302 at the bottom of the slider, the pulley 302 is slidably connected to the guide rail 20, and the slider is configured for supporting the spare drill pipe 6. Further, the first clamping position 300 and the third clamping position 301 may be clamping grooves at the top of the sliding mechanism 30.

If the sliding mechanism 30 is of a telescopic structure in this case, the slider may be a hood with an opening at the bottom, and the sliding mechanism 30 also includes a bottom plate and a scissor mechanism 303. The bottom plate is arranged at the bottom of the slider, and the pulley 302 is installed on a bottom surface of the bottom plate, and the scissor mechanism 303 is connected between a top surface of the bottom plate and an inner wall of the slider. The scissor mechanism 303 is formed by hinging multiple connecting rods and can be extended or retracted, thus driving the hollow slider to ascend or descend relative to the bottom plate.

Further, when the first clamping position 300 and the second clamping position 301 are both clamping grooves, the first clamping groove 300 and the second clamping position 301 may be located at the same height, and in this case, the first clamping position 300 and the second clamping position 301 may be distributed at the top of the sliding mechanism 30 at intervals in a moving direction of the sliding mechanism 30.

Figure 22:
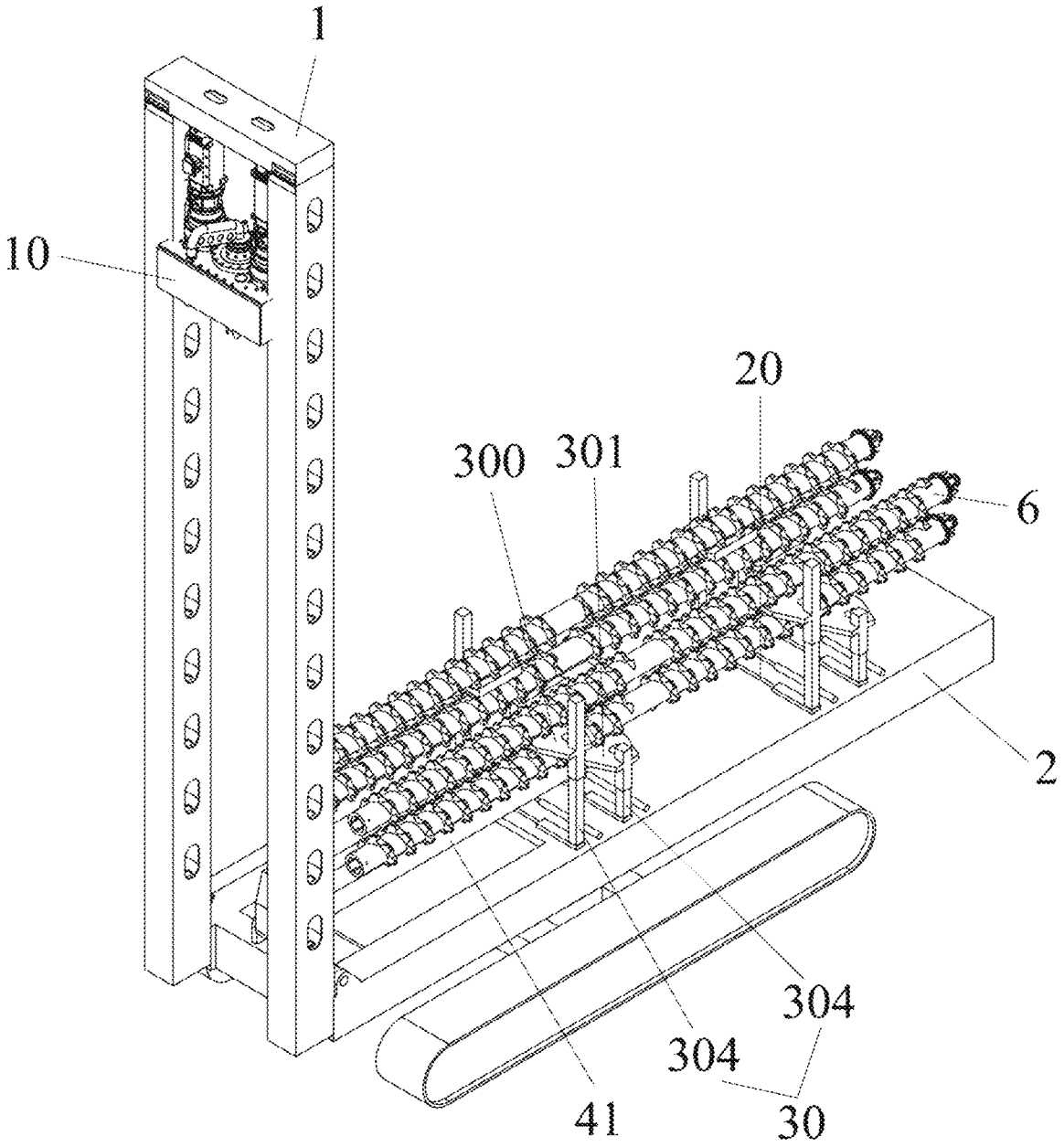
FIG. 22 is another structural schematic diagram of a piling machine according to an embodiment of the present disclosure.

Alternatively, as shown in FIG. 22, the sliding mechanism 30 may include two adjacently arranged sliding supports 304. In this case, each guide rail 20 may include two branch tracks arranged in parallel, and the two sliding supports 304 are slidably connected to the two branch tracks in one-to-one correspondence.

As shown in FIG. 22, the bottom of the sliding support 304 may be provided with a perforation. The sliding support 304 is slidably connected to the branch track of the guide rail 20 through the perforation. The first clamping position 300 and the second clamping position 301 may be made of supporting plates. In this case, the first clamping position 300 is fixedly connected to one side of one sliding support 304 of the sliding mechanism 30, and the second clamping position 301 is fixedly connected to one side of another sliding support 304 of the sliding mechanism 30.

To prevent the first clamping position 300 and the second clamping position 301 from interfering with each other, as shown in FIG. 22, a vertical distance between the first clamping position 300 and the pile frame platform 2 is not equal to that between the second clamping position 301 and the pile frame platform 2. Further, the vertical distance between the first clamping position 300 and the pile frame platform 2 may be greater than that between the second clamping position 301 and the pile frame platform 2. In this case, a height above ground of the spare drill pipe 6 supported on the first clamping positions 300 of the multiple sliding mechanisms 30 is greater than the height above ground of the spare drill pipe 6 supported on the second clamping positions 301 of the multiple sliding mechanisms 30.

Figure 23:
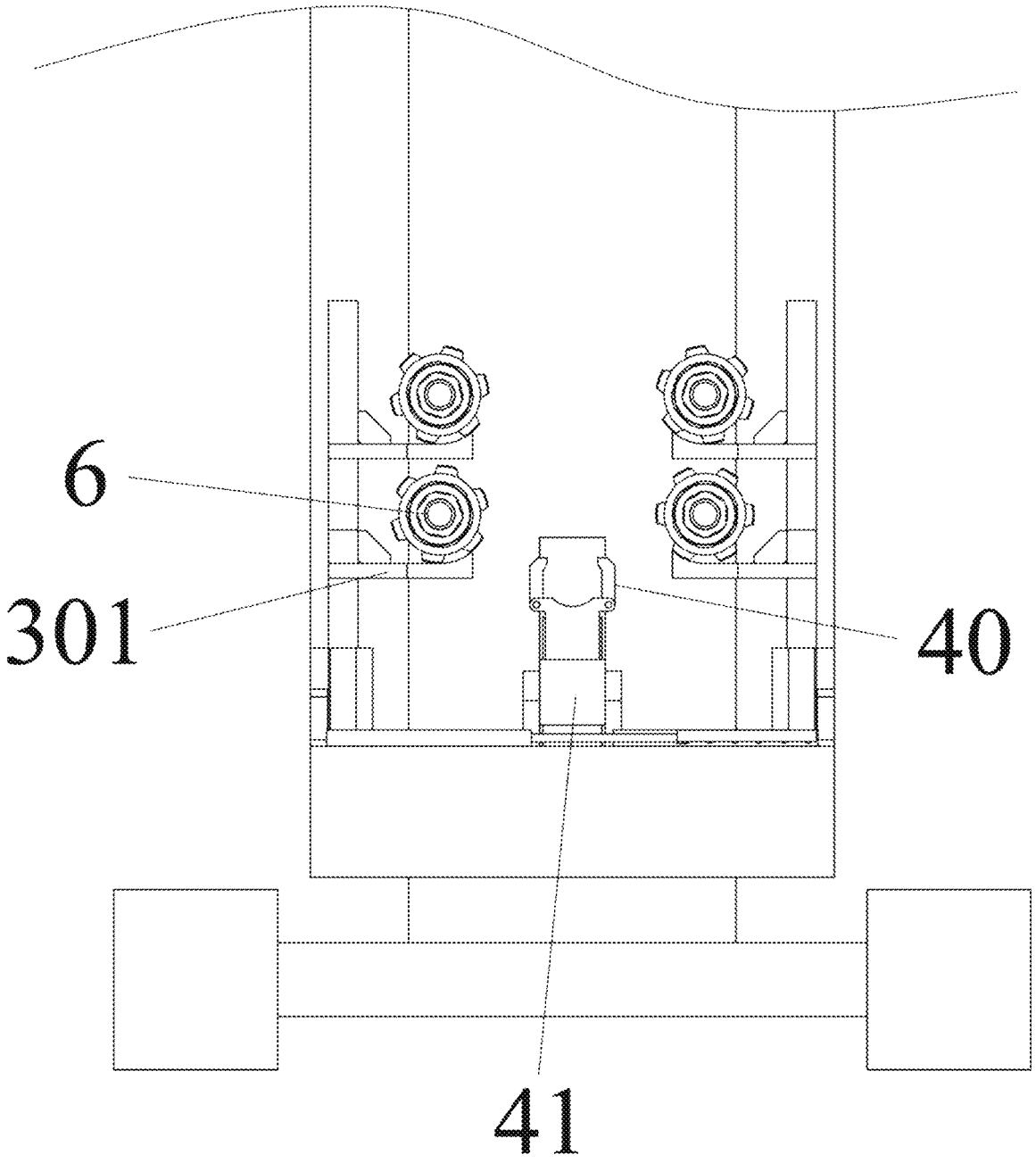
FIG. 23 is a partial side view of a piling machine in FIG. 22.

When the first clamping position 300 and the second clamping position 301 are both supporting plates, the sliding supports 304 of the multiple sliding mechanisms 30 of the moving assembly 3 may be successively moved in batches. Specifically, as shown in FIG. 23 and FIG. 24, the external force can be used to push only the sliding support 304 with the first clamping position 300 of the sliding mechanisms 30 to move in the direction parallel to the plane where the portal frame 1 is located until the spare drill pipe 6 on the first clamping position 300 is moved to the loading zone, then the picking part 40 is started to grasp the spare drill pipe 6 at the loading zone, and then the sliding support 304 with the first clamping position 300 is enabled to move back to the original position.

After the sliding support 304 provided with the first clamping position 300 is moved back to the original position, the spare drill pipe 6 at the second clamping position 301 of the sliding support 304 can be moved to the loading zone. It should be noted that as the multiple sliding mechanisms 30 of the moving assembly 3 are distributed at intervals in the direction perpendicular to the plane where the portal frame 1 is located, when the spare drill pipe 6 is no longer supported on the first clamping position 300 of the sliding supports 304, the moving process of the sliding support 304 with the second clamping position 301 is no longer hindered by the spare drill pipe 6 at the first clamping position 300. In this case, only the sliding support 304 with the second clamping position 301 of the sliding mechanism 30 is pushed to move in the direction parallel to the plane where the portal frame 1 is located by an external force until the spare drill pipe 6 at the second clamping position 301 is moved to the loading zone.

In addition, when the first clamping position 300 and the second clamping position 301 are both supporting plates and the sliding mechanism 30 is of a telescopic structure, the sliding support 304 may employ a telescopic support. Specifically, the sliding support 304 includes a horizontal rod with a perforation and a vertical rod perpendicularly connected to the horizontal rod. A sliding rod is slidably connected to the vertical rod, and the first clamping position 300 or the second clamping position 301 is arranged at one side of the sliding rod. In this case, the expansion and retraction of the sliding support 304 can be achieved by sliding the slide rod on the vertical rod, thereby driving the first clamping position 300 or the second clamping position 301 to ascend and descend.

Figure 24:
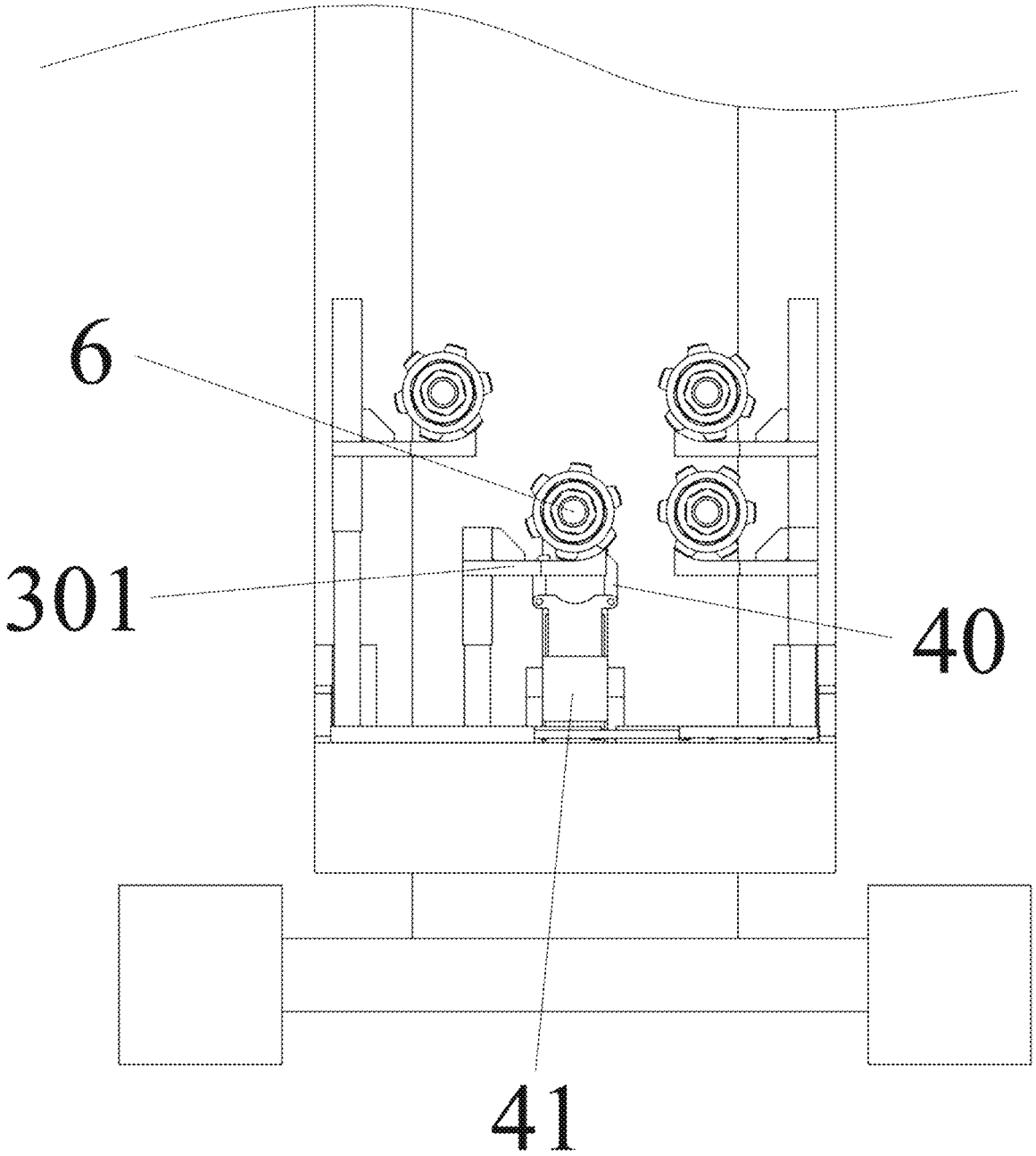
FIG. 24 is a partial side view of a piling machine according to an embodiment of the present disclosure when one of spare drill pipes in the piling machine in FIG. 22 is moved to a loading zone.
Figure 25:
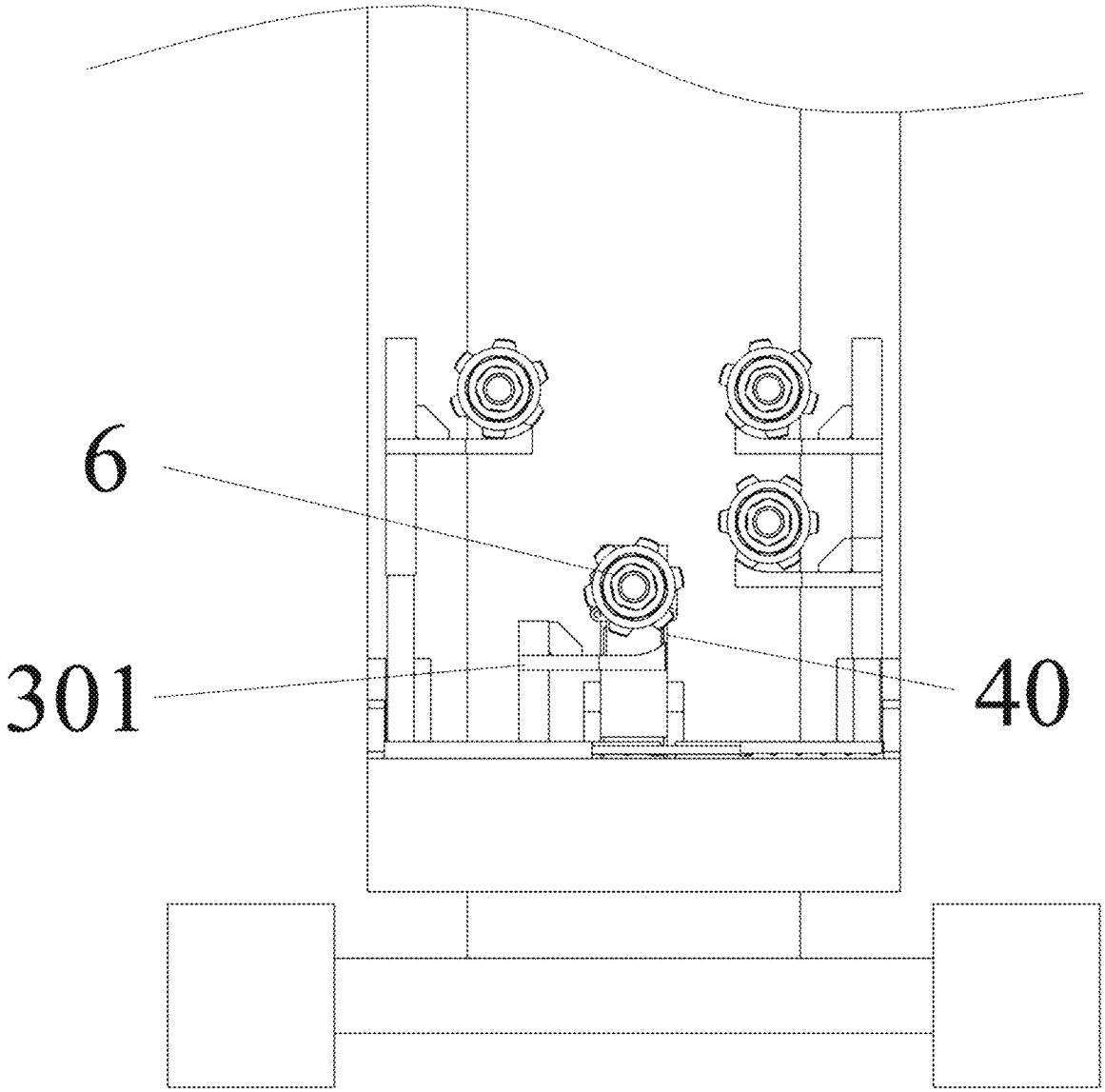
FIG. 25 is a partial side view of a piling machine when a sliding mechanism at a loading zone in a piling machine in FIG. 22 descends.

As shown in FIG. 24 and FIG. 25, after the sliding support 304 provided with the first clamping position 300 conveys the supported spare drill pipe 6 to the loading zone and the picking part 40 grasps the spare drill pipe 6, the sliding rod can be driven to slide downward along the vertical rod, thus driving the first clamping position 300 to descend. Therefore, there is a gap between the first clamping position 300 and the spare drill pipe 6, and the sliding support 304 can be easily moved reversely to return to the original position.

In this embodiment, the pile frame platform 2 may also be provided with a movement driving mechanism which is configured for applying an external force to the moving assembly 3, so as to push the moving assembly 3 to move on the pile frame platform 2. Further, the movement driving mechanism may employ an air cylinder, an oil cylinder, and other telescopic driving devices, or a conveying device including a motor and a conveyor chain.

It should be noted that the sliding mechanism 30 of the moving assembly 3 provided by the embodiment is not limited to be provided with the first clamping position 300 and the second clamping position 301, but also can be additionally provided with a third clamping position, a fourth clamping position and other clamping positions according to actual needs. Moreover, the structural form of the sliding mechanism 300 is not limited to above two, and any structure capable of orderly conveying the spare drill pipe 6 to the loading zone in a simple route can be adopted.

As shown in FIG. 5 and FIG. 6, the lifting assembly 4 includes a mechanical arm 41, and a jacking driving mechanism. The picking part 40 is a mechanical gripper. The mechanical arm 41 includes a hinged end, and a suspension end. The hinged end of the mechanical arm 41 is hinged with the pile frame platform 2, and the suspension end of the mechanical arm 41 is suspended. The mechanical gripper is installed on the mechanical arm 41, an output end of the jacking driving mechanism is connected to the mechanical arm 41, and the jacking driving mechanism is configured for driving the mechanical arm 41 to pivot relative to the pile frame platform 2, so as to make the mechanical arm 41 switch between the horizontal state and an upright state.

The jacking driving mechanism may employ an air cylinder, an oil cylinder and other telescopic driving devices. The open and close of the mechanical gripper may be achieved in a mechanical or pneumatic manner. Correspondingly, the mechanical gripper may employ an electric gripper, or a pneumatic gripper.

The mechanical arm 41 in the lifting assembly 4 provided by this embodiment is configured for switching between the horizontal state and the upright state under the driving of the jacking driving mechanism, thus driving the spare drill pipe 6 to switch between the horizontal state and the upright state. The spare drill pipe 6 can be accurately located below the power head 10 when pivoting to the upright state, and thus the mechanical arm 41 may only pivot in the range of 0-90 degrees.

In order to improve the use flexibility of the mechanical arm 41, it is preferred that the length of the mechanical arm 41 is less than that of the spare drill pipe 6, and the picking part 41 may be installed at the suspension end of the mechanical arm 41 at this time.

As shown in FIG. 5 and FIG. 6, the hinged end of the mechanical arm 41 is located between the portal frame 1 and the loading zone, the mechanical gripper is installed on an arm surface, facing away from the pile frame platform 2, of the mechanical arm 41. Alternatively, as shown in FIG. 31 to FIG. 34, the mechanical gripper is installed on the arm surface, facing the pile frame platform 2, of the mechanical arm 41, a turntable mechanism 21 is installed on the pile frame platform 2, the hinged end of the mechanical arm 41 is hinged to the turntable mechanism 21, and the turntable mechanism 21 is configured for driving the mechanical arm 41 to rotate about a central axis of the mechanical arm 41.

When the hinged end of the mechanical arm 41 is located between the portal frame 1 and the loading zone, in order to ensure that the spare drill pipe 6 can be accurately located below the power head 10 when pivoted to the upright state, after the mechanical gripper on the mechanical arm 41 grasps the spare drill pipe 6, the spare drill pipe 6 should be located on one side, close to the portal frame 1, of the mechanical arm 41. Therefore, the mechanical gripper can be directly installed on the arm surface, facing away from the pile frame platform 2, of the mechanical arm 41. Alternatively, the mechanical gripper can be installed on the arm surface, facing the pile frame platform 2, of the mechanical arm 41, and a turntable mechanism 21 is provided to allow the erected mechanical arm 41 to rotate, so as to drive the spare drill pipe 6 to steer.

Specifically, for the case of directly installing the mechanical gripper on the arm surface, facing away from the pile frame platform 2, of the mechanical arm 41, as shown in FIG. 3, FIG. 5 and FIG. 6, the mechanical gripper grasps the spare drill pipe 6 at the loading zone from bottom to top, and the grasped spare drill pipe 6 is located above the mechanical arm 41.

Figure 31:
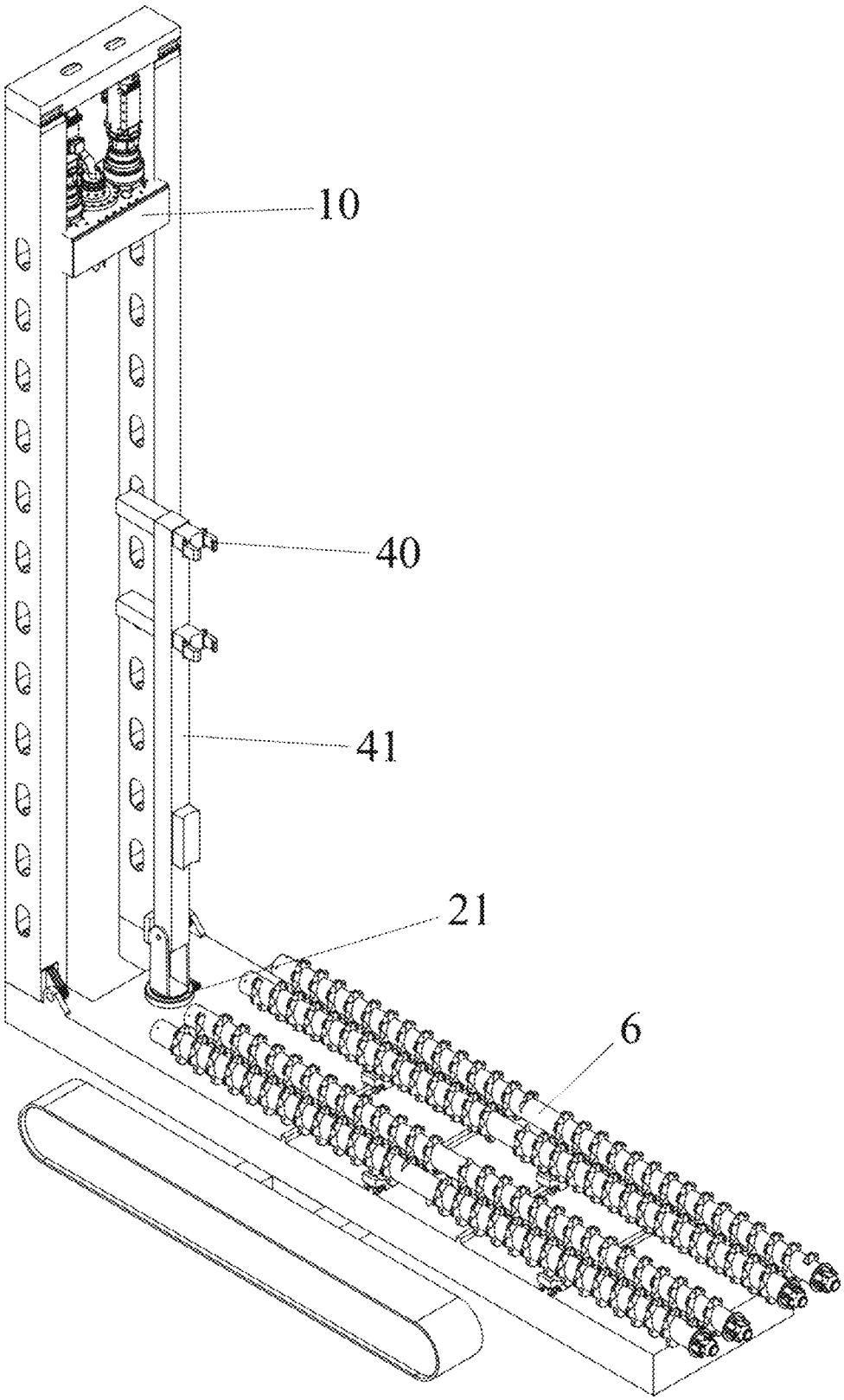
FIG. 31 is a structural schematic diagram of a piling machine including a turntable mechanism according to an embodiment of the present disclosure.
Figure 32:
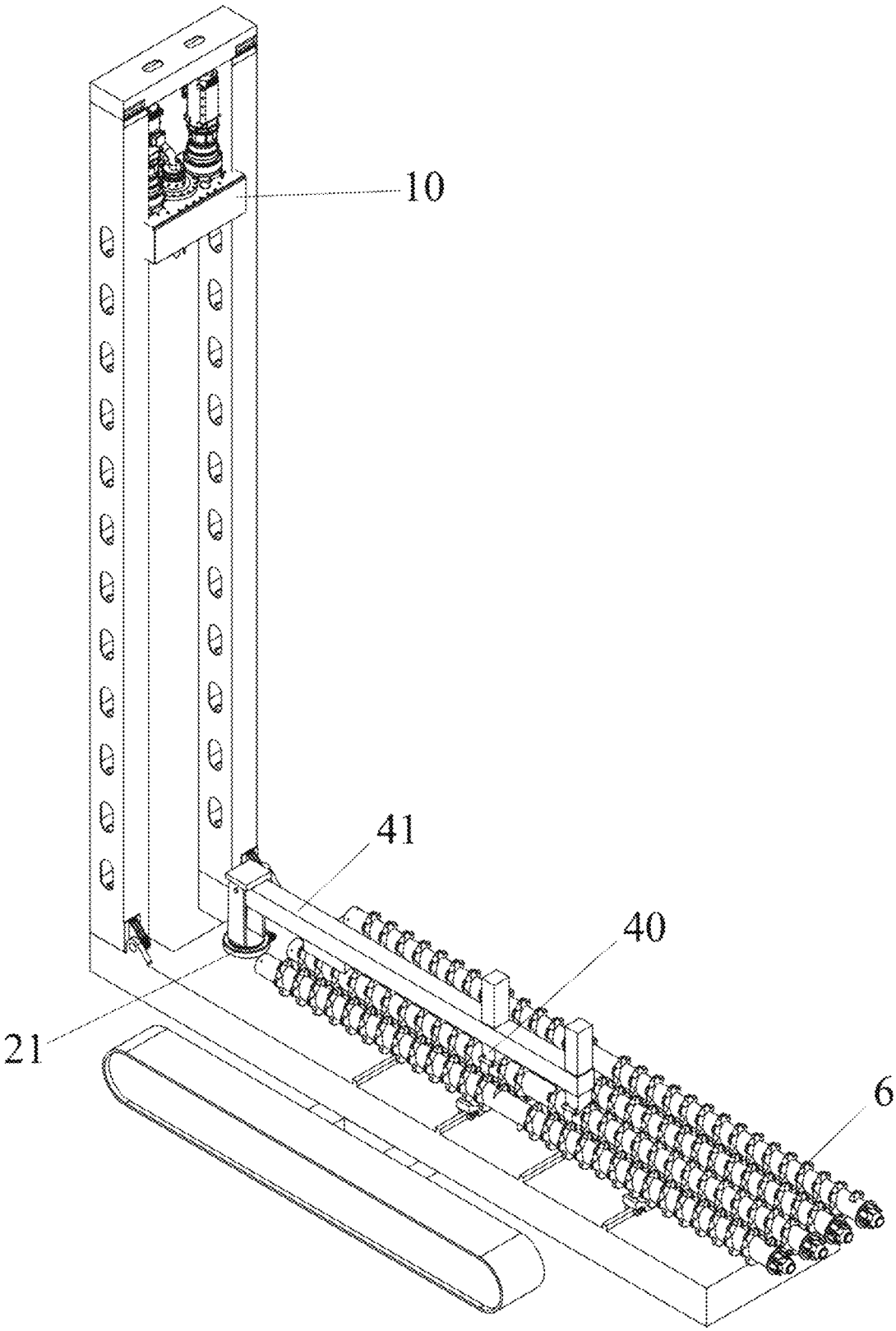
FIG. 32 is a structural schematic diagram of a piling machine when a lifting assembly in the piling machine in FIG. 31 is pivoted to a horizontal state.
Figure 33:
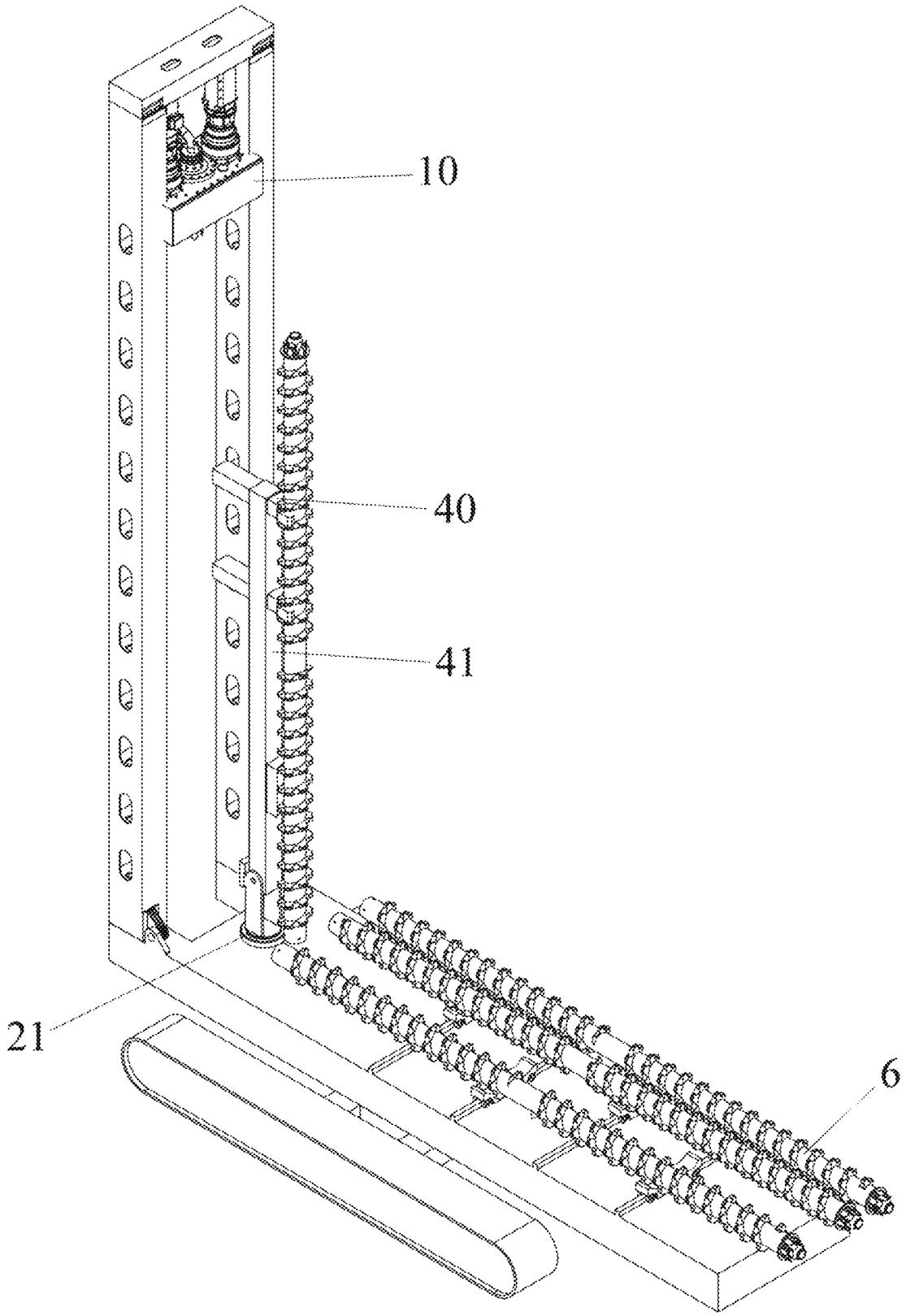
FIG. 33 is a structural schematic diagram of a piling machine when a lifting assembly of the piling machine in FIG. 31 drives one of drill pipes to pivot to an upright state.
Figure 34:
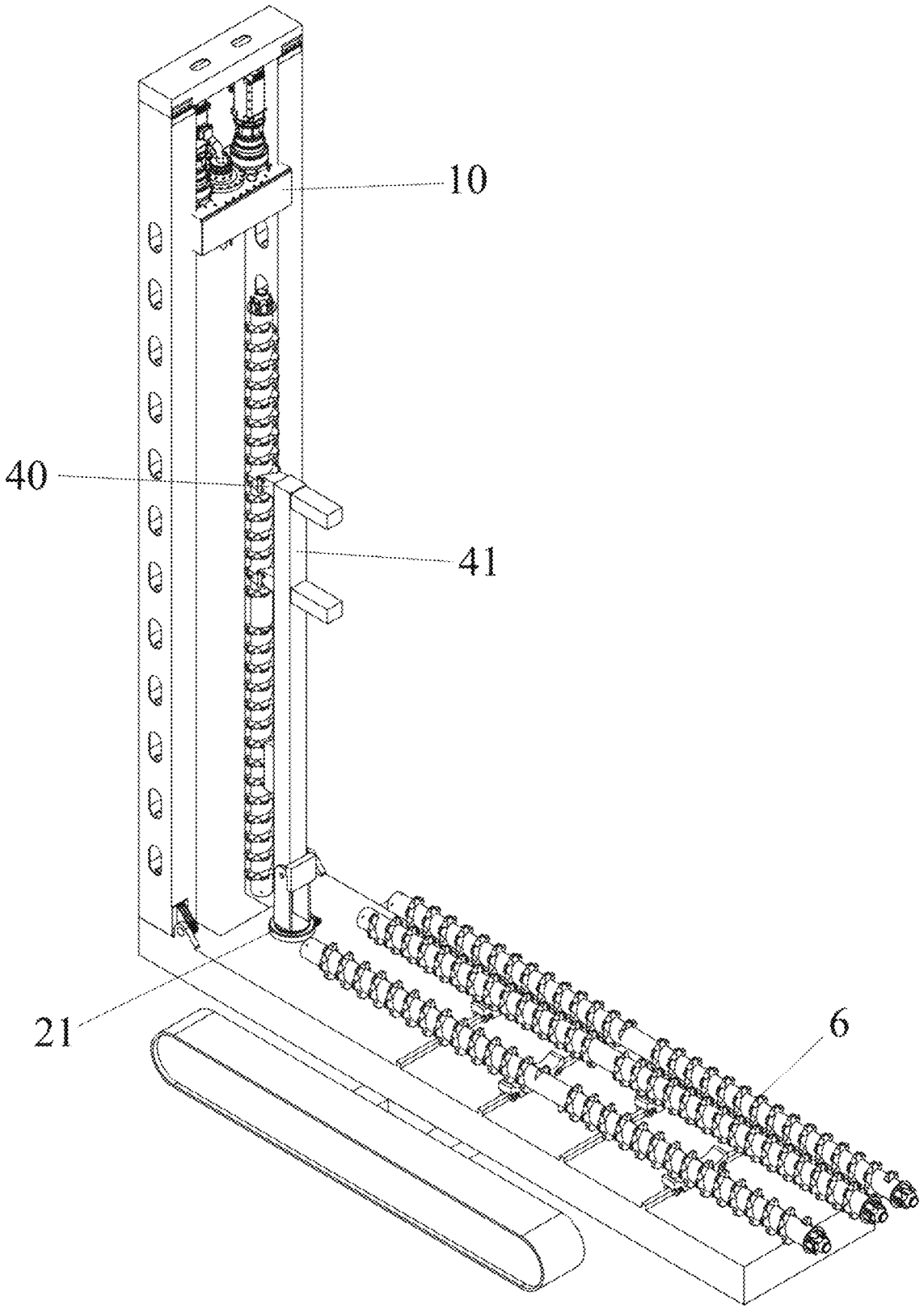
FIG. 34 is a structural schematic diagram of a piling machine after a turntable mechanism of the piling machine in FIG. 31 drives a mechanical arm to rotate.

For the case of installing the mechanical gripper on the arm surface, facing the pile frame platform 2, of the mechanical arm 41, as shown in FIG. 31 and FIG. 32, the mechanical gripper grabs the spare drill pipe 6 at the loading zone from top to bottom, and the grasped spare pipe drill 6 is located below the mechanical arm 41. After the mechanical arm 41 drives the spare drill pipe 6 to pivot to the upright state, as shown in FIG. 33, the spare drill pipe 6 is located at one side, facing away from the portal frame 1, of the mechanical arm 41, and in this case, in order to locate the spare drill pipe 6 on one side, facing the portal frame 1, of the mechanical arm 41 and located below the power head 10, and the turntable mechanism 21 is required to drive the mechanical arm 41 to rotate 180 degrees, so as to move the spare drill pipe 6 to a position below the power head 10.

The turntable mechanism 21 may employ a rotary driving device including a motor.

In this embodiment, after the mechanical gripper grasps the spare drill pipe 6 by adjusting the position of the mechanical arm 41, the spare drill pipe 6 can be located at one side, close to the portal frame 1, of the mechanical arm 41. Specifically, as shown in FIG. 26 to FIG. 30, an extension frame 22 is connected to one side, provided with the portal frame 1, of the pile frame platform 2, the hinged end of the mechanical arm 41 is hinged to the extension frame 22, the mechanical arm 41 can be erected at one side, facing away from the loading zone, of the portal frame 1 after passing through the portal frame 1 in the process of pivoting relative to the pile frame platform 2. The mechanical gripper is installed on the arm surface, facing the pile frame platform 2, of the mechanical arm 41.

Figure 26:
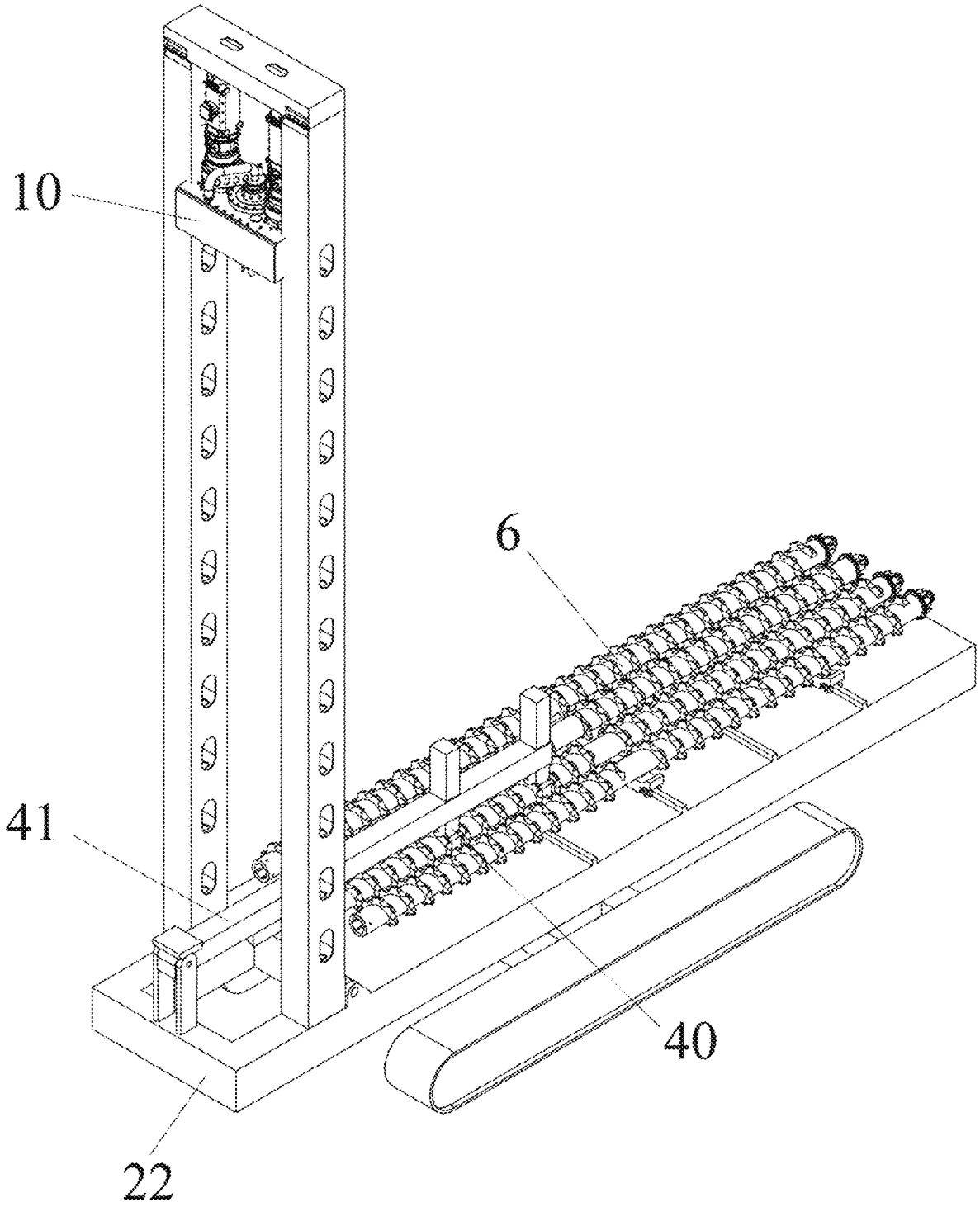
FIG. 26 is still another structural schematic diagram of a piling machine according to an embodiment of the present disclosure.
Figure 27:
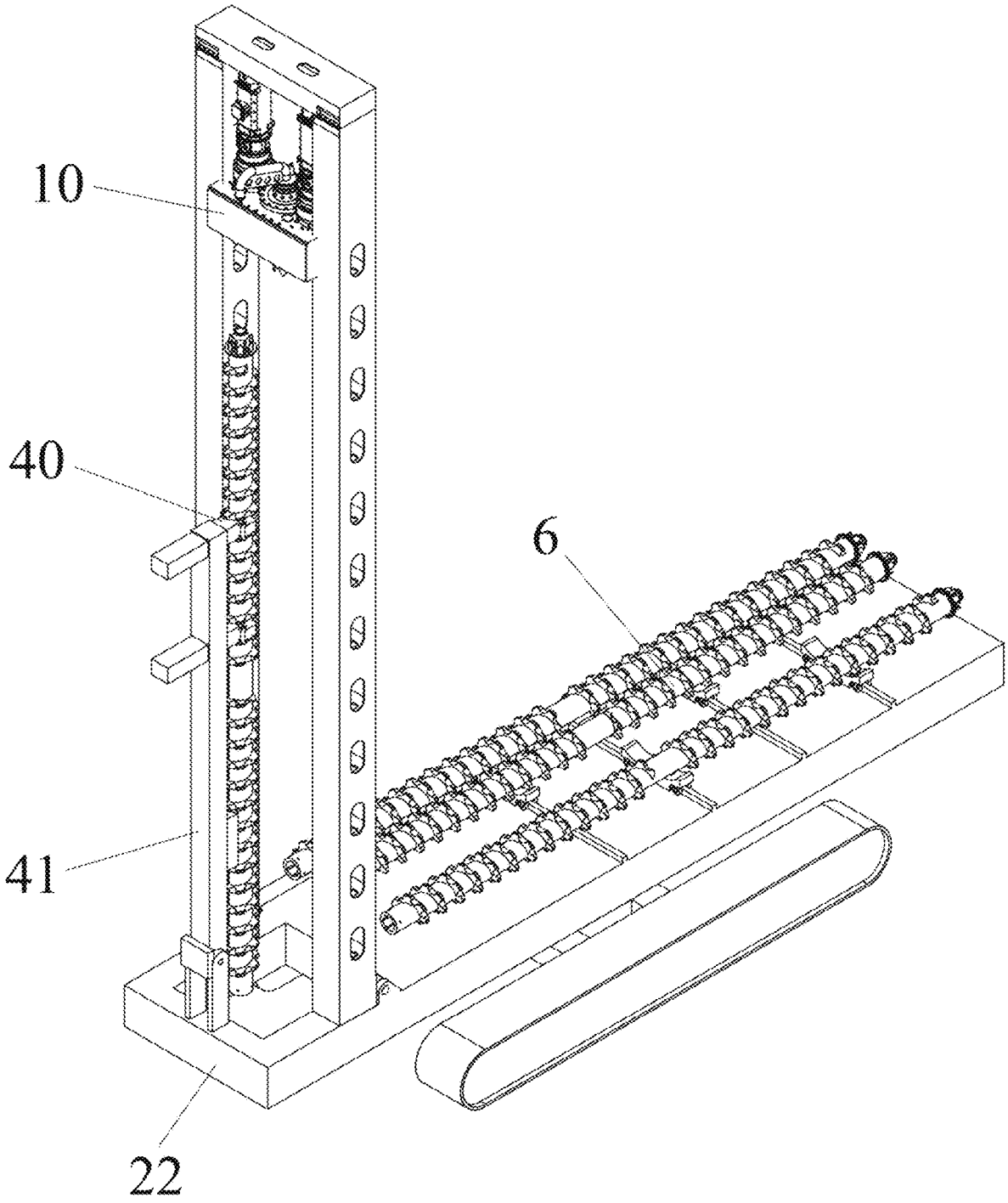
FIG. 27 is a structural schematic diagram of a piling machine when a lifting assembly in a piling machine in FIG. 26 is pivoted to an upright state.

As shown in FIG. 26, the mechanical gripper grasps the spare drill pipe 6 at the loading zone from top to bottom, and the grasped spare drill pipe 6 is located below the mechanical arm 41. In the process of driving the spare drill pipe 6 to pivot to the upright state by the mechanical arm 41, as the hinged end of the mechanical arm 41 is hinged to the extension frame 22, the mechanical arm 41 drives the spare drill pipe 6 to pass through the portal frame 1, as shown in FIG. 27. In this case, the spare drill pipe 6 is located at one side, facing the portal frame 1, of the mechanical arm 41, and is located below the power head 10.

Figure 28:
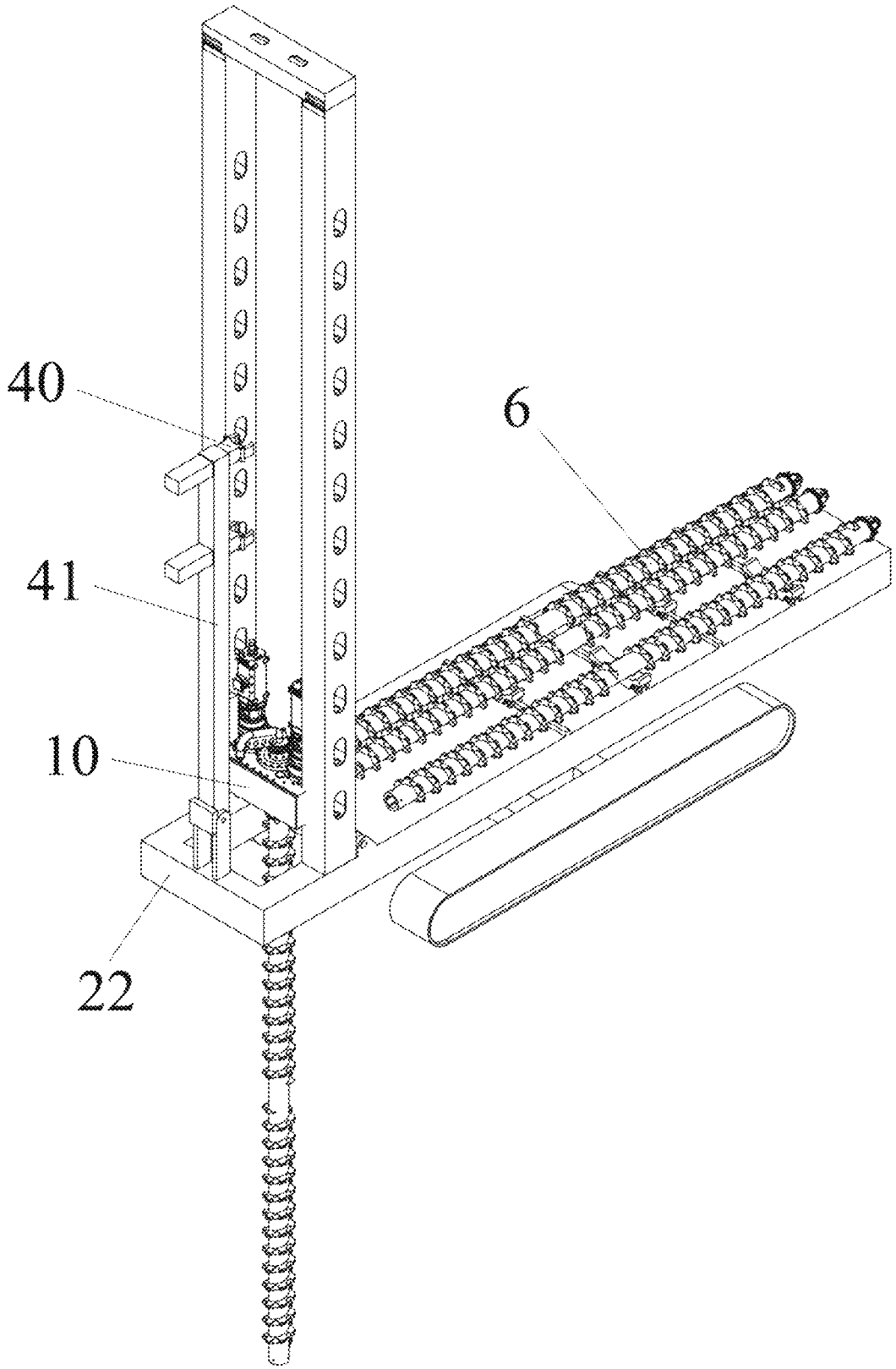
FIG. 28 is a structural schematic diagram of a piling machine when a spare drill pipe in a piling machine in FIG. 26 drills down.
Figure 29:
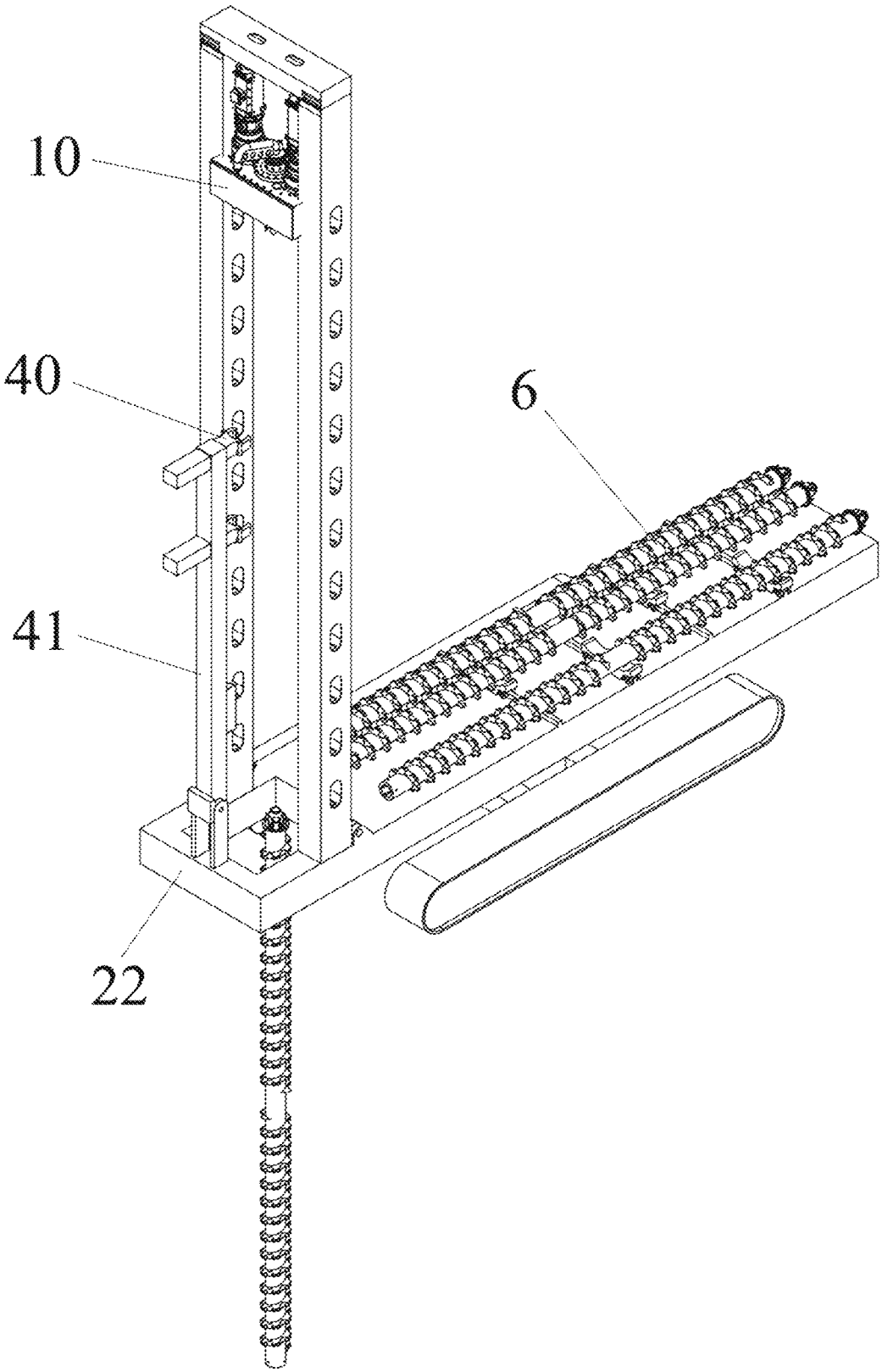
FIG. 29 is a structural schematic diagram of a piling machine when a spare drill pipe in a piling machine in FIG. 26 drills down.
Figure 30:
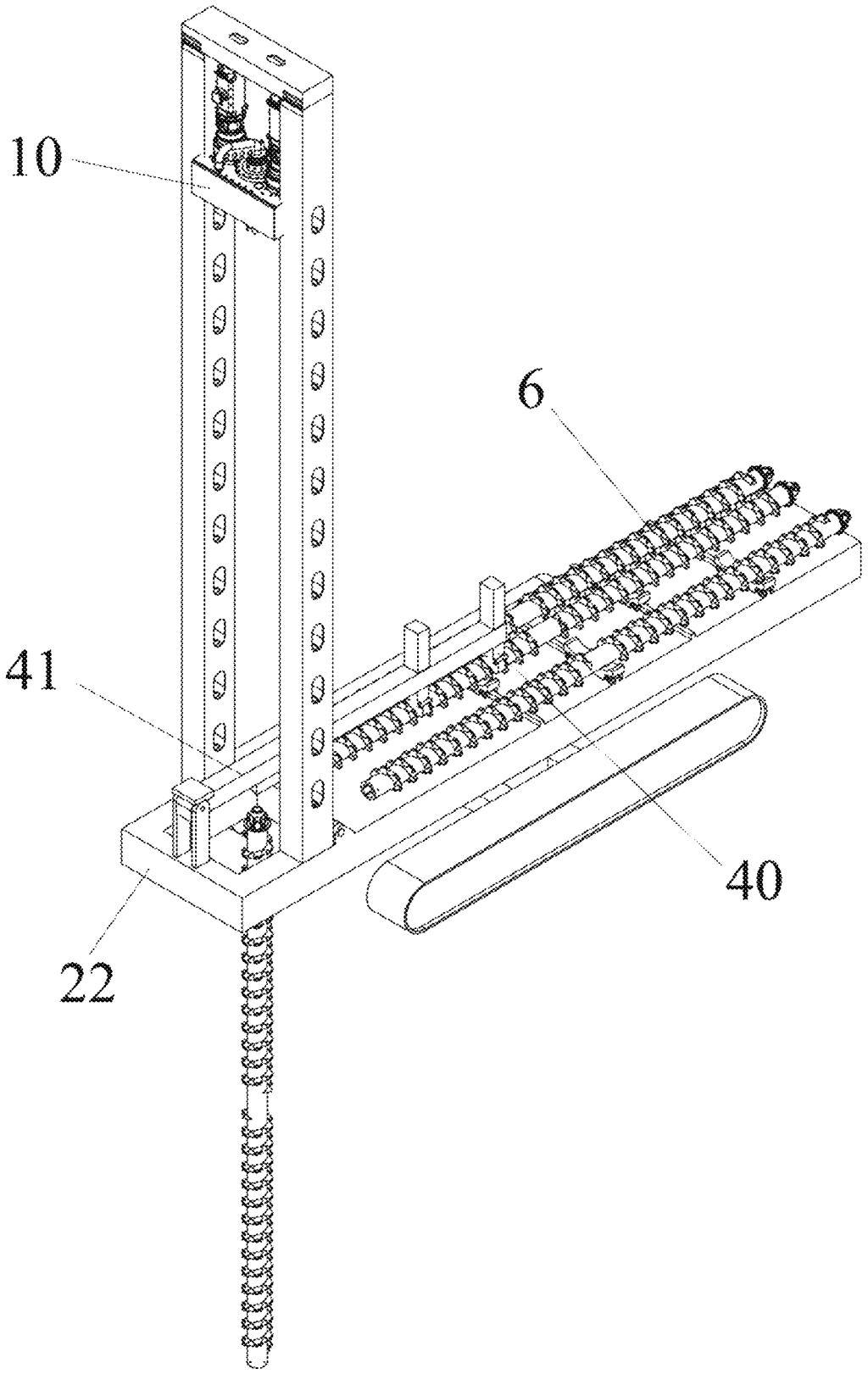
FIG. 30 is a structural schematic diagram of a piling machine after a spare drill pipe in the piling machine in FIG. 26 drills down and a lifting assembly is reversely pivoted to a horizontal state.

In addition, in order to prevent the mechanical arm 41 from hindering the connection process of the spare drill pipes 6, as shown in FIG. 28 and FIG. 29, in the processes that the drill pipes are connected and the power head 10 ascends after the drill pipes are connected, the mechanical arm 41 needs to be kept upright. When the next spare drill pipe 6 needs to be picked, as shown in FIG. 30, the mechanical arm 41 pivots to the horizontal state.

It should be noted that in order to prevent the extension frame 22 from hindering the connecting and drilling process of the drill pipes, a position of the extension frame 22 corresponding to the power head 10 need to be provided with through holes for the power head 10 and the drill pipe to pass through.

In order to improve the balance of the piling machine, the preferred piling machine in this embodiment further includes a counterweight structure, and the counterweight structure is installed on one side, opposite to the portal frame 1, of the portal frame platform 2, thus preventing the center of gravity of the pile driver from shifting to one side of the portal frame 1. In this embodiment, preferably, the counterweight structure is a self-adjusting counterweight assembly 8. Further, the piling machine includes a monitoring system, and a control system 9. The self-adjusting counterweight assembly 8 is installed on one side, away from the portal frame 1, of the portal frame platform 2, and includes a moving portion capable of moving in a direction perpendicular to the plane where the portal frame 1 is located. The self-adjusting counterweight assembly 8 and the monitoring system are both connected to the control system 9. The monitoring system is configured to monitor a weight change at the portal frame 1 of the piling machine, and the control system 9 is configured to calculate a amount of moving of the moving portion according to the weight change monitored by the monitoring system, and to drive the moving portion to move in the direction perpendicular to the plane where the portal frame 1 is located according to the moving amount.

The self-adjusting counterweight assembly 8 may employ a telescopic structure. In this case, the moving portion is a telescopic end of the self-adjusting counterweight assembly 8, the monitoring system is configured for sensing the weight change at the portal frame 1 of the piling machine, and the control system 9 can control the telescopic amount of the self-adjusting counterweight assembly 8 according to a monitoring result of the monitoring system, such that the self-adjusting counterweight assembly 8 can automatically extend or retract according to the weight change at the portal frame 1 to adjust a torque of one side, away from the portal frame 1, of the pile driver platform 2, thus changing the center of gravity of the piling machine and maintaining the balance of the piling machine.

Further, the self-adjusting counterweight assembly 8 may employ an oil cylinder. In practical application, the self-adjusting counterweight assembly 8 may also employ a slide block slidably connected to the pile frame platform 2. The monitoring system may include a weight sensor, and the control system 9 may employ a programmable logic controller, or a single microcomputer. The control system 9 may also be connected to the moving assembly 3, and the moving assembly 3 can be controlled by the control system 9 to move in a preset path, and there is no need of a cab on the piling machine.

In conclusion, according to the piling machine provided by this embodiment, the spare drill pipes 6 can be placed on the moving assembly 3 in parallel, then moved transversely in order to be conveyed to the loading zone. Afterwards, by means of the pivoting process of the lifting assembly 4, the multiple spare drill pipes 6 can be orderly sent to a position below the power head 10 on the portal frame 1 in a simple route, so as to be connected. The piling machine can complete the processes of grasping and connecting the drill pipes through simple actions, and the construction requirements of a super-long pile can be satisfied by connecting the drill pipes, and the height of the portal frame 1 does not need to be set too high. Therefore, the portal pile machine provided by this embodiment can achieve the construction of cast-in-place piles with different pile lengths in spaces with different heights (including low spaces such as tunnels) by horizontally placing and orderly combining the drill pipes, and automatically, highly and safely connecting the drill pipes on the premise of using the low portal frame 1.

It can be seen that the piling machine provided by this embodiment breaks the traditional design concept that the height of the upright column and the length of the drilling tool must satisfy the design pile length in the current mainstream heavy pile driver, and solves the problem that the vertical pre-fixed spare heavy drilling tool often causes the center of gravity of the pile driver to shift, resulting in the overweight front end of the pile driver. The piling machine provided by this embodiment is a subversive technology to the existing pile driver, can achieve the lowering of the portal frame 1, the flat laying of the drill pipes and automatic connection of the drill pipes, and is an efficient, energy-saving, safe, high-automatic and low-cost piling machinery.

It also should be noted that when a spare heavy drilling tool is vertically fixed to one side of the upright column of the existing portal frame 1 of the pile driver in advance, in order to ensure the balance of the center of gravity of the pile driver, a counterweight has to be added, thus a phenomenon that the weight of the pile driver is often increased from 150 tons to more than 300 tons when driving a pile of 70 meters occurs, which increases the construction cost. Moreover, in order to ensure the safety of the pile, steel plates need to be laid in a large area on the construction site before construction, which further increases the construction cost. According to the piling machine provided by this embodiment, the drilling depth of the drilling tool is not limited to the length of a single drilling tool by laying the drill pipes flat, and there is no need of increasing the counterweight to guarantee the balance of the center of gravity of the pile driver. For this alone, the weight of the piling machine provided by this embodiment can be reduced by 30-40% compared with the existing pile driver, thus effectively reducing the manufacturing cost of the pile driver. In addition, the piling machine provided by this embodiment employs a vertical force applying mechanism to cooperate with the power head 10 at the portal frame 1, such that the soil can be squeezed during the drilling process of the drill pipe, and a pile hole can be dug by rotation, the construction without taking soil is achieved, and the purposes of energy saving and emission reduction are achieved.

It should be noted that, compared with CN202688997U, the piling machine provided by this embodiment provides a specific technical solution of lowering the height and the center of gravity of the portal frame 1 and increasing the length of the constructed pile.

Compared with the technical solution of CN208950504U, which can increase the piling depth only by one time, and increases the hidden danger of the unstable center of gravity of the pile driver, the piling machine provided by this embodiment can achieve more times of piling depth in a case of enhancing the stability of the pile driver without increasing the height of the pile driver (the piling machine provided by this embodiment does not need to consider the unstable center of gravity caused by the erected drill pipes, and the piling depth can be increased by adding the number or length of spare drill pipes 6).

Compared with CN203851446U, through the vertical force applying mechanism, the power head 10 on the portal frame 1 and the connector assembly with an elastic pin, the piling machine provided by this embodiment also has complex functions that cannot be associated with the agricultural technical field, such as rotating the drilling tool, drilling down, lifting the drilling tool and automatically connecting the drill pipes. In addition, according to the piling machine provided by this embodiment, a single-column upright column of the traditional pile driver can be replaced with the portal frame 1, and thus the spare drill pipe 6 can be directly moved into the portal frame 1, or directly pass through the portal frame 1, without bypassing the single-column upright column and taking a complicated route.

Compared with CN209556966U, according to the piling machine provided by this embodiment, the moving assembly 3 can be moved away after the drill pipe is grasped by the picking part 40, and there is no free fall of the drill pipe in the whole process. In the operating process, multiple drill pipes can be automatically conveyed to the loading zone in turn by pre-programming the control system 9 of the piling machine, such that the pick-up part 40 can automatically pick up multiple drill pipes in turn without manpower or other auxiliary machinery to convey the drill pipes.

Compared with CN110939132A, the self-adjusting counterweight assembly 8 of the piling machine provided by this embodiment can cooperate with the control system 9 and the monitoring system, so as to have the characteristics of rapid adjustment. According to the piling machine provided by this embodiment, the mode for adjusting the horizontal center of gravity position by changing the torque is more in line with the requirements of the piling machine provided by this embodiment.

However, about the piling machinery provided by CN216381270U, CN105756060A and CN107023267B, due to the limitation of the traditional single-column upright column structure, the grasping and moving processes of the corresponding drill pipes have to bypass the single upright column, which in turn leads to the complicated mechanism of the pile machinery and difficulty in simplification. Although the erection of the drill pipes 6 is beneficial to the conveying and connecting of the drill pipes, the instability of the pile foundation is caused. However, according to the piling machine provided by this embodiment, a way of laying the spare drill pipes 6 flat is provided, combined with the improvement of the whole machine structure, the process of grasping and moving the drill pipe can be achieved smoothly when employing the low portal frame 1. Compared with the piling machinery with erected drill pipes, the piling machine provided by this embodiment is safer, and more stable. Meanwhile, by laying the drill pipes flat, the contact area between the drill pipes and the pile frame platform 2 can be increased, the point load when placing the drill pipe vertically is changed into a surface load with smaller pressure after the drill pipe is placed flat. The strength requirement of the pile driver can be reduced, and thus the manufacturing cost of the pile driver is reduced.

Figure 35:
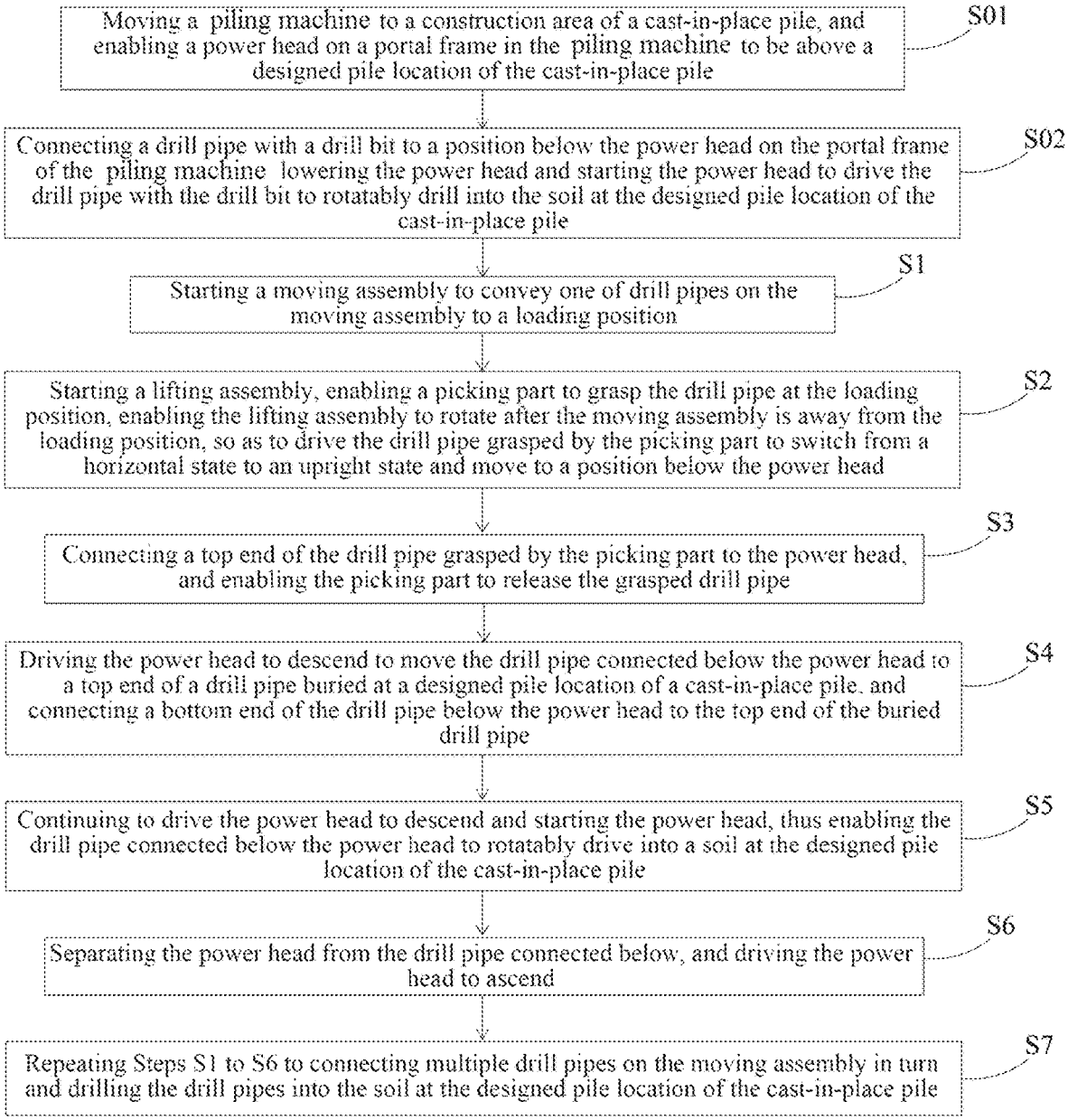
FIG. 35 is a flow chart of a cast-in-place pile construction method according to an embodiment of the present disclosure.

As shown in FIG. 35, a cast-in-place pile construction method is provided by this embodiment, which is carried out by the piling machine above, and includes the following steps.

- S1: starting a moving assembly 3 to convey one of drill pipes on the moving assembly 3 to a loading zone;
- S2: starting a lifting assembly 4, enabling a picking part 40 to grasp the drill pipe at the loading zone, enabling the lifting assembly 4 to pivot after the moving assembly 3 is away from the loading zone, so as to drive the drill pipe grasped by the picking part 40 to switch from a horizontal state to an upright state and move to a position below a power head 10;
- S3: connecting a top end of the drill pipe grasped by the picking part 40 to the power head 10, and then enabling the picking part 40 to release the grasped drill pipe;
- S4: driving the power head 10 to descend to move the drill pipe connected below the power head 10 to a top end of a drill pipe buried at a designed pile location of the cast-in-place pile, and connecting a bottom end of the drill pipe connected below the power head 10 to the top end of the buried drill pipe;
- S5: continuing to drive the power head 10 to descend and starting the power head 10, thus enabling the drill pipe connected below the power head 10 to rotate and drill into soil at the designed pile location of the cast-in-place pile;
- S6: separating the power head 10 from the drill pipe connected below the power head 10, and driving the power head 10 to ascend; and
- S7: repeating steps of S1 to S6 to connect multiple drill pipes on the moving assembly 3 in turn and drill the drill pipes into the soil at the designed pile location of the cast-in-place pile.

Steps S1-S7 of the cast-in-place pile construction method provided by this embodiment are all the connecting processes of the drill pipes laid flat on the pile frame platform 2, i. e. the connecting processes of the spare drill pipe 6 mentioned above. However, the original drill pipe 5 with the drill bit is usually directly connected below the power head 10 to ready for drilling. Therefore, the cast-in-place pile construction method provided by this embodiment may further include steps of S01 and S02 before the step of S1:

S01: moving the piling machine to a construction area of the cast-in-place pile, and enabling the power head 10 on the portal driver 1 of the piling machine to be located above the designed pile location of the cast-in-place pile; and

S02: connecting the drill pipe with the drill bit below the power head 10 on the portal frame 1 of the piling machine, lowering the power head 10 and starting the power head 10 to drive the drill pipe with the drill bit to rotate and drill into the soil at the designed pile location of the cast-in-place pile.

The cast-in-place construction method provided by this embodiment is carried out by the piling machine, and through the cast-in-place pile construction method, the pile driver can be balanced by distributing the multiple drill pipes horizontally on the moving assembly 3, so as to guarantee the stability of the piling machine. In the process of the connecting the drill pipes, the center of gravity of the piling machine is continuously kept from shifting to the portal frame 1 by the drilling down process after the drill pipes are connected and the horizontally distributed drill pipes that have not been connected, thus continuing to guarantee the use stability of the piling machine.

Finally, it should be noted that the above embodiments are only used to illustrate the technical solution of the present disclosure rather than limiting. Although the present disclosure has been described in detail with reference to the foregoing embodiments, those of ordinary skill in the art should understand that it is still possible to modify the technical solution recorded in the foregoing embodiments, or to replace some technical features with equivalents. However, these modifications or replacements do not make the essence of the corresponding technical solutions deviate from the spirit and scope of the technical solutions of various embodiments of the present disclosure.

What is claimed is:

1. A piling machine, comprising a portal frame, a pile frame platform, a moving assembly, a lifting assembly, a self-adjusting counterweight assembly, a monitoring system, and a control system;

wherein the portal frame is erected on one side of the pile frame platform, a power head capable of ascending and descending is installed on the portal frame, and the power head is able to be detachably connected to one end of a drill pipe moved to a position below the power head;

a loading zone is located at a position of the pile frame platform at one side of the portal frame, and a projection of a central shaft of the power head on the pile frame platform is located in an extension direction of the loading zone;

the moving assembly is located at one side or each of both sides of the loading zone, a plurality of drill pipes are horizontally distributed on the moving assembly, and each drill pipe is perpendicular to a plane where the portal frame is located; the moving assembly is configured for moving on a horizontal plane in a direction parallel to the plane where the portal frame is located, so as to convey the plurality of drill pipes to the loading zone in turn;

the lifting assembly comprises a picking part, the picking part is configured for grasping the drill pipe at the loading zone; the lifting assembly is configured for pivoting relative to the pile frame platform, so as to drive the drill pipe grasped by the picking part to switch from a horizontal state to an upright state and to move to the position below the power head in the pivoting process;

wherein the moving assembly comprises a plurality of sliding mechanisms, and the plurality of sliding mechanisms are distributed at intervals in a direction perpendicular to the plane where the portal frame is located, and the plurality of sliding mechanisms are configured for supporting the plurality of drill pipes and moving the plurality of drill pipes; and in the direction perpendicular to the plane where the portal frame is located, the picking part at the loading zone and the plurality of sliding mechanisms are distributed in a staggered manner;

wherein the plurality of sliding mechanisms are of a telescopic structure, and configured for driving the drill pipe supported by the plurality of sliding mechanisms to ascend and descend in a process of extending and retracting the plurality of sliding mechanisms;

wherein each sliding mechanism is provided with a first clamping position and a second clamping position distributed at an interval, first clamping positions of the plurality of sliding mechanisms are distributed in a straight line so as to support a drill pipe, and second clamping positions of the plurality of sliding mechanisms are distributed on an other straight line to support an other drill pipe, wherein the self-adjusting counterweight assembly is installed on one side, away from the portal frame, of the pile frame platform, and comprises a moving portion capable of moving in the direction perpendicular to the plane where the portal frame is located;

the self-adjusting counterweight assembly and the monitoring system are both connected to the control system, and the monitoring system is configured for monitoring a weight change at the portal frame of the piling machine, and the control system is configured for calculating an amount of moving of the moving portion according to the weight change monitored by the monitoring system, and driving the moving portion to move in the direction perpendicular to the plane where the portal frame is located according to the moving amount.

2. The piling machine according to claim 1, wherein the pile frame platform is provided with a plurality of guide rails, the plurality of guide rails are distributed at intervals in the direction perpendicular to the plane where the portal frame is located, and each guide rail extends in the direction parallel to the plane where the portal frame is located; and the plurality of sliding mechanisms are slidably connected to the plurality of guide rails, respectively.

3. The piling machine according to claim 2, wherein the lifting assembly comprises a mechanical arm and a jacking driving mechanism, and the picking part is a mechanical gripper;

the mechanical arm comprises a hinged end, and a suspension end, the hinged end of the mechanical arm is hinged with the pile frame platform, and the suspension end of the mechanical arm is suspended; and the mechanical gripper is installed on the mechanical arm, an output end of the jacking driving mechanism is connected to the mechanical arm, the jacking driving mechanism is configured for driving the mechanical arm to pivot relative to the pile frame platform, so as to make the mechanical arm switch between the horizontal state and the upright state.

4. The piling machine according to claim 2, further comprising a self-adjusting counterweight assembly, a monitoring system, and a control system;

wherein the self-adjusting counterweight assembly is installed on one side, away from the portal frame, of the pile frame platform, and comprises a moving portion capable of moving in the direction perpendicular to the plane where the portal frame is located;

the self-adjusting counterweight assembly and the monitoring system are both connected to the control system, and the monitoring system is configured for monitoring a weight change at the portal frame of the piling machine, and the control system is configured for calculating an amount of moving of the moving portion according to the weight change monitored by the monitoring system, and driving the moving portion to move in the direction perpendicular to the plane where the portal frame is located according to the moving amount.

5. A cast-in-place pile construction method carried out by the piling machine according to claim 2, and the method comprising following steps:

S1: starting the moving assembly to convey one of the plurality of drill pipes on the moving assembly to the loading zone;

S2: starting the lifting assembly, enabling the picking part to grasp the drill pipe at the loading zone, moving the moving assembly away from the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and S7: repeating steps of S1 to S6 to connect the plurality of drill pipes on the moving assembly in turn and drill the plurality of drill pipes into the soil at the designed pile location of the cast-in-place pile.

6. The piling machine according to claim 1, wherein the lifting assembly comprises a mechanical arm, and a jacking driving mechanism, and the picking part is a mechanical gripper;

the mechanical arm comprises a hinged end, and a suspension end, the hinged end of the mechanical arm is hinged with the pile frame platform, and the suspension end of the mechanical arm is suspended; and the mechanical gripper is installed on the mechanical arm, an output end of the jacking driving mechanism is connected to the mechanical arm, the jacking driving mechanism is configured for driving the mechanical arm to pivot relative to the pile frame platform, so as to make the mechanical arm switch between the horizontal state and the upright state.

7. The piling machine according to claim 6, wherein the hinged end of the mechanical arm is located between the portal frame and the loading zone, and the mechanical gripper is installed on an arm surface, facing away from the pile frame platform, of the mechanical arm; or the mechanical gripper is installed on an arm surface, facing the pile frame platform, of the mechanical arm, and a turntable mechanism is installed on the pile frame platform, the hinged end of the mechanical arm is hinged to the turntable mechanism, and the turntable mechanism is configured for driving the mechanical arm to rotate about a central axis of the mechanical arm.

8. A cast-in-place pile construction method carried out by the piling machine according to claim 7, and the method comprising following steps:

S1: starting the moving assembly to convey one of the plurality of drill pipes on the moving assembly to the loading zone;

S2: starting the lifting assembly, enabling the picking part to grasp the drill pipe at the loading zone, moving the moving assembly away from the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and S7: repeating steps of S1 to S6 to connect the plurality of drill pipes on the moving assembly in turn and drill the plurality of drill pipes into the soil at the designed pile location of the cast-in-place pile.

9. The piling machine according to claim 6, wherein an extension frame extends from the pile frame platform in a direction away from the loading zone and beyond the portal frame, the hinged end of the mechanical arm is hinged to the extension frame, the mechanical arm is able to be erected at one side, facing away from the loading zone, of the portal frame after passing through the portal frame in a process of pivoting relative to the pile frame platform; and the mechanical gripper is installed on an arm surface, facing the pile frame platform of the mechanical arm.

10. A cast-in-place pile construction method carried out by the piling machine according to claim 9, and the method comprising following steps:

S1: starting the moving assembly to convey one of the plurality of drill pipes on the moving assembly to the loading zone;

S2: starting the lifting assembly, enabling the picking part to grasp the drill pipe at the loading zone, moving the moving assembly away from the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and S7: repeating steps of S1 to S6 to connect the plurality of drill pipes on the moving assembly in turn and drill the plurality of drill pipes into the soil at the designed pile location of the cast-in-place pile.

11. A cast-in-place pile construction method carried out by the piling machine according to claim 6, and the method comprising following steps:

S1: starting the moving assembly to convey one of the plurality of drill pipes on the moving assembly to the loading zone;

S2: starting the lifting assembly, enabling the picking part to grasp the drill pipe at the loading zone, moving the moving assembly away from the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and S7: repeating steps of S1 to S6 to connect the plurality of drill pipes on the moving assembly in turn and drill the plurality of drill pipes into the soil at the designed pile location of the cast-in-place pile.

12. A cast-in-place pile construction method carried out by the piling machine according to claim 1, and the method comprising following steps:

S1: starting the moving assembly to convey one of the plurality of drill pipes on the moving assembly to the loading zone;

S2: starting the lifting assembly, enabling the picking part to grasp the drill pipe at the loading zone, moving the moving assembly away from the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and S7: repeating steps of S1 to S6 to connect the plurality of drill pipes on the moving assembly in turn and drill the plurality of drill pipes into the soil at the designed pile location of the cast-in-place pile.

13. A cast-in-place pile construction method carried out by the piling machine according to claim 1, and the method comprising following steps:

S1: starting the moving assembly to convey one of the plurality of drill pipes on the moving assembly to the loading zone;

S2: starting the lifting assembly, enabling the picking part to grasp the drill pipe at the loading zone, moving the moving assembly away from the loading zone, enabling the lifting assembly to pivot after the moving assembly is away from the loading zone, so as to drive the drill pipe grasped by the picking part to switch from the horizontal state to the upright state and move to the position below the power head;

S3: connecting a top end of the drill pipe grasped by the picking part to the power head, and then enabling the picking part to release the grasped drill pipe;

S4: driving the power head to descend to move the drill pipe connected below the power head to a top end of a drill pipe buried at a designed pile location of a cast-in-place pile, and connecting a bottom end of the drill pipe connected below the power head to the top end of the buried drill pipe;

S5: continuing to drive the power head to descend and starting the power head, thus enabling the drill pipe connected below the power head to rotate and drill into soil at the designed pile location of the cast-in-place pile;

S6: separating the power head from the drill pipe connected below the power head, and driving the power head to ascend; and S7: repeating steps of S1 to S6 to connect the plurality of drill pipes on the moving assembly in turn and drill the plurality of drill pipes into the soil at the designed pile location of the cast-in-place pile.

* * * * *